US011133596B2

(12) United States Patent
Ou et al.

(10) Patent No.: US 11,133,596 B2
(45) Date of Patent: Sep. 28, 2021

(54) ANTENNA WITH GRADIENT-INDEX METAMATERIAL

(71) Applicant: QUALCOMM Incorporated, San Diego, CA (US)

(72) Inventors: Yu-Chin Ou, San Diego, CA (US); Mohammad Ali Tassoudji, San Diego, CA (US)

(73) Assignee: QUALCOMM Incorporated, San Diego, CA (US)

( * ) Notice: Subject to any disclaimer, the term of this patent is extended or adjusted under 35 U.S.C. 154(b) by 298 days.

(21) Appl. No.: 16/145,799

(22) Filed: Sep. 28, 2018

(65) Prior Publication Data

US 2020/0106188 A1 Apr. 2, 2020

(51) Int. Cl.

| | |
|---|---|
| ***H01Q 21/06*** | (2006.01) |
| ***H01Q 15/00*** | (2006.01) |
| ***H01Q 5/357*** | (2015.01) |

(52) U.S. Cl.

CPC ..... *H01Q 15/0086* (2013.01); *H01Q 5/357* (2015.01); *H01Q 21/065* (2013.01)

(58) Field of Classification Search

CPC .. H01Q 15/0086; H01Q 5/357; H01Q 21/065; H01Q 9/0442; H01Q 9/0414

See application file for complete search history.

(56) References Cited

U.S. PATENT DOCUMENTS

| | | | |
|---|---|---|---|
| 7,218,285 | B2 | 5/2007 | Davis et al. |
| 7,764,232 | B2 | 7/2010 | Achour et al. |
| 9,035,831 | B2 | 5/2015 | Mookiah et al. |
| 9,583,839 | B2 | 2/2017 | Liu et al. |
| 9,659,899 | B2 | 5/2017 | Sane et al. |
| 2007/0052587 | A1 | 3/2007 | Cheng |
| 2012/0068901 | A1 | 3/2012 | Ryou et al. |

(Continued)

FOREIGN PATENT DOCUMENTS

| | | | |
|---|---|---|---|
| EP | 0911906 | B1 | 3/2006 |
| EP | 2201642 | A1 | 6/2010 |

(Continued)

OTHER PUBLICATIONS

Buell K., et al., "A Substrate for Small Patch Antennas Providing Tunable Miniaturization Factors," IEEE Transactions on Microwave Theory and Techniques, vol. 54(1), Jan. 2006, pp. 135-146.

(Continued)

*Primary Examiner* — Awat M Salih
(74) *Attorney, Agent, or Firm* — Qualcomm Incorporated

(57) ABSTRACT

Techniques for improving the bandwidth performance of an antenna assembly in a mobile device are provided. An example of an apparatus according to the disclosure includes a dielectric substrate having a first area and a second area disposed around the first area, a first radiator disposed on a surface of the dielectric substrate in the first area, the first radiator being configured to transmit and receive radio signals at an operational frequency, and a plurality of metamaterial structures disposed in a periodic pattern on the surface of the dielectric substrate in the second area and within a near field of the first radiator, wherein a maximum width of each of the plurality of metamaterial structures is less than half of a wavelength of the operational frequency.

28 Claims, 18 Drawing Sheets

(56) References Cited

U.S. PATENT DOCUMENTS

| | | | | |
|---|---|---|---|---|
| 2012/0299797 | A1 | 11/2012 | Murdock et al. | |
| 2013/0027269 | A1 | 1/2013 | Orime et al. | |
| 2014/0354513 | A1 | 12/2014 | Nair et al. | |
| 2016/0028161 | A1* | 1/2016 | Kawaguchi | H01Q 1/32 343/700 MS |
| 2019/0229398 | A1* | 7/2019 | Ryoo | H01Q 1/243 |
| 2020/0388924 | A1* | 12/2020 | Lee | H01Q 9/285 |

FOREIGN PATENT DOCUMENTS

| | | | |
|---|---|---|---|
| KR | 10-1367959 | * | 2/2014 |
| KR | 20140014520 | A | 2/2014 |

OTHER PUBLICATIONS

Li J L-W., "A Broadband and High-Gain Metamaterial Microstrip Antenna", Department of Electrical & Computer Engineering, National University of Singapore, Project Final Technical Report, May 8, 2010, 19 pages.

International Search Report and Written Opinion—PCT/US2019/051232—ISA/EPO—dated Dec. 5, 2019.

Yuting Z., et al., "A High Gain Patch Antenna Using Negative Permeability Metamaterial Structures", 2017 Progress in Electromagnetics Research Symposium—Fall (PIERS—FALL), IEEE, Nov. 19, 2017 (Nov. 19, 2017), pp. 119-123, XP033321887, DOI: 10.1109/PIERS-FALL.2017.8293122, [retrieved on Feb. 14, 2018], abstract; figures 1,2,6, p. 119-p. 122.

Chen K., et al., "Improving Microwave Antenna Gain and Bandwidth with Phase Compensation Metasurface," AIP Advances 5, 2015, pp. 067152-1 to 067152-8.

Erfani E., et al., "A High-Gain Broadband Gradient Refractive Index Metasurface Lens Antenna," IEEE Transactions on Antennas and Propagation, May 2016, vol. 64, No. 5, pp. 1968-1973.

Erfani E., et al., "A High-Gain Lens Antenna Based on Gradient-Index Metamaterial," IEEE, 2015, pp. 868-869.

* cited by examiner

ANTENNA WITH GRADIENT-INDEX METAMATERIAL

BACKGROUND

Wireless communication devices are increasingly popular and increasingly complex. For example, mobile telecommunication devices have progressed from simple phones, to smart phones with multiple communication capabilities (e.g., multiple cellular communication protocols, Wi-Fi, BLUETOOTH® and other short-range communication protocols), supercomputing processors, cameras, etc. Wireless communication devices have antennas to support wireless communication over a range of frequencies.

It is often desirable to increase the operational antenna bandwidth of a wireless communication system. Mobile communication devices typically have multiple antenna systems that are each required to be thin to fit within a thin form factor of the mobile communication device (e.g., a smartphone, tablet computer, etc.). Typical antenna bandwidth enhancements include enlarging a radiating aperture of the antenna system. For example, parasitic elements may be added in proximity of a main radiating element. The dimensions of the parasitic elements are usually on the order of a half wavelength of an operational frequency to support resonance. In certain implementations, such dimensions may be difficult to maintain within the thin form factor required in modern mobile communication devices.

SUMMARY

An example of an apparatus according to the disclosure includes a dielectric substrate having a first area and a second area disposed around the first area, a first radiator disposed on a surface of the dielectric substrate in the first area, the first radiator being configured to transmit and receive radio signals at an operational frequency, and a plurality of metamaterial structures disposed in a periodic pattern on the surface of the dielectric substrate in the second area and within a near field of the first radiator, wherein a maximum width of each of the plurality of metamaterial structures is less than half of a wavelength of the operational frequency.

Implementations of such an apparatus may include one or more of the following features. The plurality of metamaterial structures may be disposed on the second area of the dielectric substrate to increase a dielectric constant of the second area as compared to the first area at the operational frequency. Each of the plurality of metamaterial structures may be a metal square. The maximum width of each of the plurality of metamaterial structures may be in a range between one-fifth and one-twentieth of the wavelength of the operational frequency. The first radiator and a first plurality of metamaterial structures may be disposed on a first plane of the dielectric substrate. At least a second radiator and a second plurality of metamaterial structures may be disposed on a second plane within the dielectric substrate, the second radiator may be disposed in the first area of the dielectric substrate under the first radiator, and the second plurality of metamaterial structures may be disposed in the second area of the dielectric substrate under the plurality of metamaterial structures. The first radiator may be operably coupled to a feedline and the second radiator is a parasitic element. At least a second radiator may be disposed in a third area on the surface of the dielectric substrate, such that at least a portion of the plurality of metamaterial structures may be disposed in a fourth area surrounding the third area on the surface of the dielectric substrate. The first radiator may be a metallic patch. Each of the plurality of metamaterial structures may be a conductive loop structure. The plurality of metamaterial structures may form at least two concentric perimeters in the second area around the first radiator. The plurality of metamaterial structures may form at least three concentric perimeters in the second area around the first radiator. The operational frequency may be within a range from 28 gigahertz to 300 gigahertz.

An example of an antenna in a wireless device for transmitting and receiving radio signals according to the disclosure includes a first radiator disposed in a first area on a printed circuit board and configured to transmit and receive radio signals at an operational frequency, and a plurality of metamaterial structures disposed in a periodic pattern in a second area on the printed circuit board, the second area being within a near field of the first radiator and surrounding the first area, wherein a maximum width of each of the plurality of metamaterial structures is less than half of a wavelength of the operational frequency.

Implementations of such an antenna may include one or more of the following features. The plurality of metamaterial structures may be disposed in the second area on the printed circuit board to increase a dielectric constant of the second area of the printed circuit board at the operational frequency. Each of the plurality of metamaterial structures may comprise a metal square. A maximum width of each of the plurality of metamaterial structures may be in a range between one-fifth and one-twentieth of the wavelength of the operational frequency. At least a second radiator may be disposed in the first area and under the first radiator, and a second plurality of metamaterial structures may be disposed in the second area under the plurality of metamaterial structures. The first radiator may be operably coupled to a feedline and the second radiator is a parasitic element. At least a second radiator may be disposed in a third area on the printed circuit board, such that at least a portion of the plurality of metamaterial structures may be disposed in a fourth area on the printed circuit board encircling the third area, at least a portion of the second area and at least a portion of the fourth area may be between the first area and the third area. The first radiator may be a metallic patch. Each of the plurality of metamaterial structures may be a conductive loop structure. The plurality of metamaterial structures may form at least two concentric perimeters around the first radiator. The plurality of metamaterial structures may form at least three concentric perimeters around the first radiator. The operational frequency may be within a range from 28 gigahertz to 300 gigahertz.

An example of an apparatus according to the disclosure includes a dielectric substrate comprising a plurality of layers, means for radiating radio signals at an operational frequency, the means for radiating being formed in at least one of the plurality of layers in a first area of the dielectric substrate, and means for increasing a dielectric constant in a second area of the dielectric substrate surrounding the first area, the means for increasing being formed throughout the plurality of layers in the second area.

Implementations of such an apparatus may include one or more of the following features. The means for increasing may comprise a plurality of metal structures disposed in a periodic pattern in the second area. The plurality of metal structures may form at least two concentric perimeters around the means for radiating. The plurality of metal structures may form at least three concentric perimeters around the means for radiating. A plurality of means for radiating radio signals may be formed in two or more of the plurality of layers Items and/or techniques described herein may provide one or more of the following capabilities, as well as other capabilities not mentioned. An antenna array may be fabricated in an integrated circuit in an electronic device. The bandwidth of an antenna array may be enhanced by changing the dielectric constant of the substrate near the elements of the antenna array. A Gradient-Index (GRIN) metamaterial may be used to modify the dielectric constant of substrate around an antenna element. The composition and arrangement of the GRIN metamaterial may be designed to create antenna gain and directivity improvements. For example, use of the GRIN metamaterial may increase bandwidth and impedance match at far out scan angles The GRIN metamaterial may include periodic metamaterial structures to create different dielectric constants. The metamaterial structures are substantially smaller than the wavelength of the antenna operating frequency. The metamaterial structures may be metallic and may increase the metal density of the antenna structure which may reduce warping and thickness variation issues in a Printed Circuit Board (PCB) manufacturing process. Further, it may be possible for an effect noted above to be achieved by means other than that noted, and a noted item/technique may not necessarily yield the noted effect.

DETAILED DESCRIPTION

Techniques are discussed herein for, among other things, improving the bandwidth performance of an antenna assembly in a mobile device. For example, many mobile devices include millimeter-wave (MMW) modules to support higher RF frequencies (e.g., 5th Generation and/or certain Wi-Fi specifications). Increasing the bandwidth performance of an antenna system may enable higher data transfer speeds across a wider spectrum of the RF frequencies. Antenna bandwidth enhancement may be realized using substrates constituted of materials with different dielectric constants. In an embodiment, a layered stack-up may utilize gradient-index (GRIN) metamaterials including periodic metallic structures to create the different dielectric constants. In addition to modifying the dielectric constant of a substrate, the periodic metallic metamaterial structure also increases the metal density in the antenna structure which can reduce warping and thickness variation issues in PCB manufacturing processes. The disclosed designs utilize GRIN metamaterials (i.e., metamaterials) in the near-field region of a radiating source, as opposed to other solutions which typically use metamaterials in a plane wave environment in a far-field region.

Figure 1:
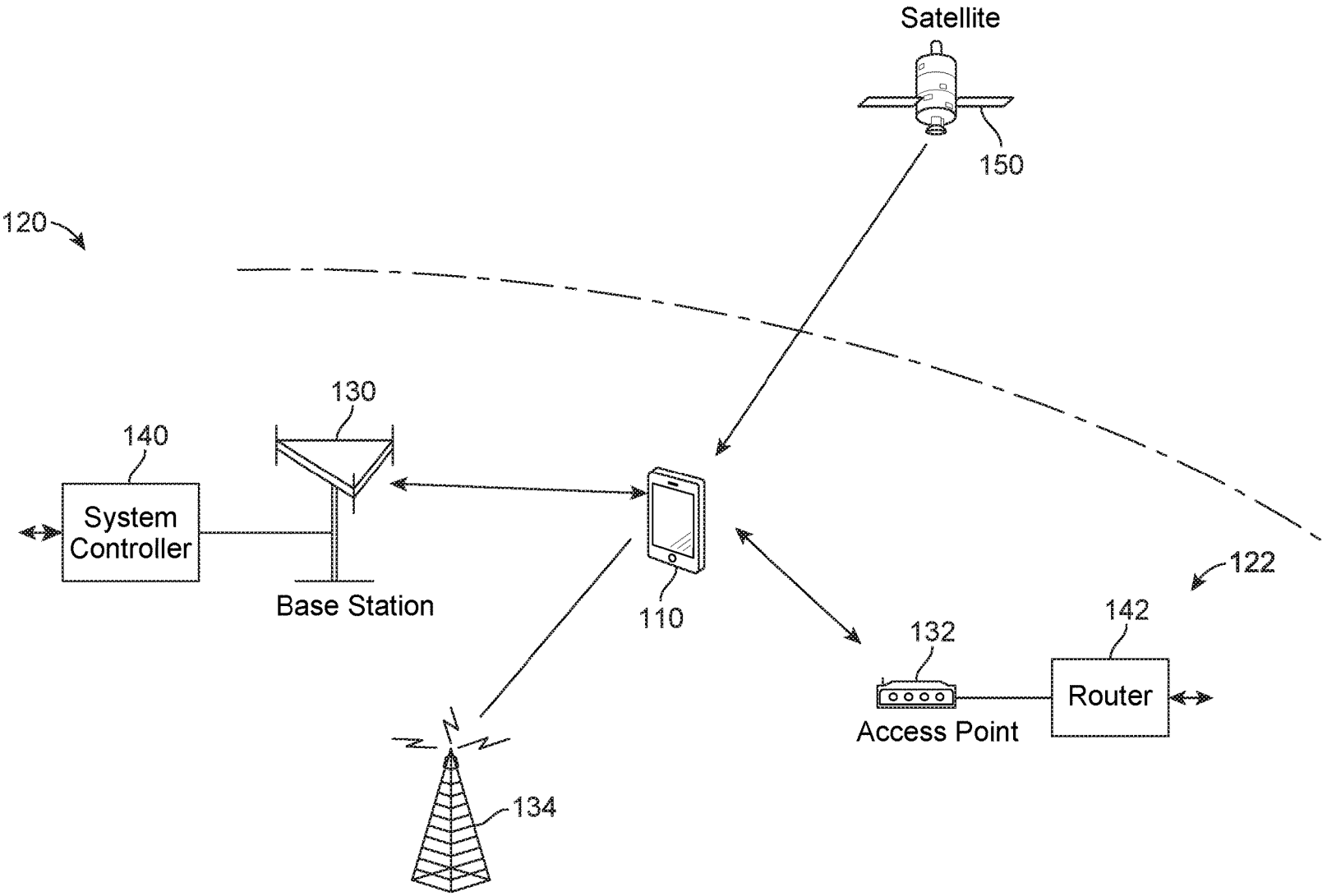
FIG. 1 shows a wireless device capable of communicating with different wireless communication systems.

Referring to FIG. 1, a wireless device 110 capable of communicating with different wireless communication systems 120 and 122 is shown. Wireless system 120 may be a Code Division Multiple Access (CDMA) system (which may implement Wideband CDMA (WCDMA), cdma2000, or some other version of CDMA), a Global System for Mobile Communications (GSM) system, a Long Term Evolution (LTE) system, a 5G system, etc. Wireless system 122 may be a wireless local area network (WLAN) system, which may implement IEEE 802.11, etc. For simplicity, FIG. 1 shows wireless system 120 including one base station 130 and one system controller 140, and wireless system 122 including one access point 132 and one router 142. In general, each system may include any number of stations and any set of network entities.

Wireless device 110 may also be referred to as a user equipment (UE), a mobile device, a mobile station, a terminal, an access terminal, a subscriber unit, a station, etc. Wireless device 110 may be a cellular phone, a smart phone, a tablet, a wireless modem, a personal digital assistant (PDA), a handheld device, a laptop computer, a smartbook, a netbook, a cordless phone, a wireless local loop (WLL) station, a Bluetooth device, etc. Wireless device 110 may be equipped with any number of antennas. Further, other wireless devices (whether mobile or not) may be implemented within the systems 120 and/or 122 as the wireless device 110 and may communicate with each other and/or with the base station 130 or access point 132. For example, such other devices may include internet of thing (IoT) devices, medical devices, home entertainment and/or automation devices, etc. Multiple antennas may be used to provide better performance, to simultaneously support multiple services (e.g., voice and data), to provide diversity against deleterious path effects (e.g., fading, multipath, and interference), to support multiple-input multiple-output (MIMO) transmission to increase data rate, and/or to obtain other benefits. Wireless device 110 may be capable of communicating with wireless system 120 and/or 122. Wireless device 110 may also be capable of receiving signals from broadcast stations (e.g., a broadcast station 134). Wireless device 110 may also be capable of receiving signals from satellites (e.g., a satellite 150), for example in one or more global navigation satellite systems (GNSS).

In general, wireless device 110 may support communication with any number of wireless systems, which may employ radio signals including technologies such as WCDMA, cdma2000, LTE, GSM, 802.11, GPS, etc. Wireless device 110 may also support operation on any number of frequency bands.

Wireless device 110 may support operation at a very high frequency, e.g., within millimeter-wave (MMW) frequencies from 28 to 300 gigahertz (GHz). For example, wireless device 110 may operate at 60 GHz for 802.11ad. Wireless device 110 may include an antenna system to support operation at MMW frequencies. The antenna system may include a number of antenna elements, with each antenna element being used to transmit and/or receive signals. The terms "antenna" and "antenna element" are synonymous and are used interchangeably herein. Generally, each antenna element may be implemented with a patch antenna or a strip-type antenna. A suitable antenna type may be selected for use based on the operating frequency of the wireless device, the desired performance, etc. In an exemplary design, an antenna system may include a number of patch and/or strip-type antennas supporting operation at MMW frequency. Other radiator geometries and configurations may also be used. For example strip-shape antennas such as single-end fed, circular, and differential fed structures may be used.

Figure 2:
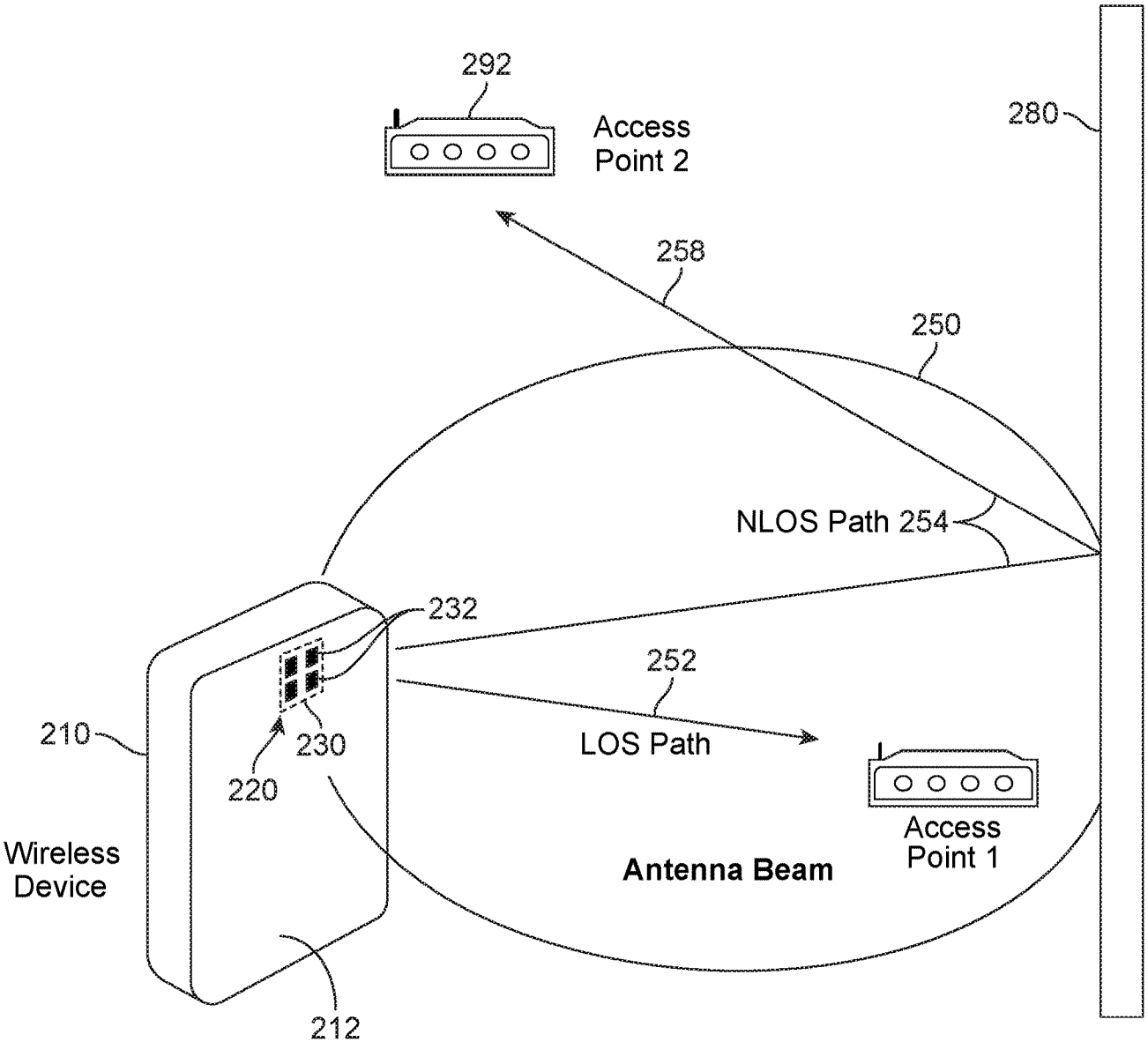
FIG. 2 shows a wireless device with a 2-dimensional (2-D) antenna system.

Referring to FIG. 2, an exemplary design of a wireless device 210 with a 2-D antenna system 220 is shown. In this exemplary design, antenna system 220 includes a 2×2 array 230 of four patch antennas 232 (i.e., radiators) formed on a single plane corresponding to a back surface of wireless device 210. While the antenna system 220 is visible in FIG. 2, in operation the patch array may be disposed on a PC board or other assembly located inside of a device cover 212. An antenna element may be used to transmit and/or receive signals. The antenna element may have a particular antenna beam pattern and a particular maximum antenna gain, which may be dependent on the design and implementation of the antenna element. Multiple antenna elements may be formed on the same plane and used to improve antenna gain. Higher antenna gain may be desirable at MMW frequency since (i) it is difficult to efficiently generate high power at MMW frequency and (ii) attenuation loss may be greater at MMW frequency. These limitations may be exacerbated by the presence of a back cover or other housing element or device component between a MMW antenna element and the other devices. The patch antenna array 230 has an antenna beam 250, which may be formed to point in a direction that is orthogonal to the plane on which patch antennas 232 are formed or in a direction that is within a certain angle of orthogonal, for example up to 60 degrees in any direction from orthogonal. Wireless device 210 can transmit signals directly to other devices (e.g., access points) located within antenna beam 250 and can also receive signals directly from other devices located within antenna beam 250. Antenna beam 250 thus represents a line-of-sight (LOS) coverage of wireless device 210.

For example, an access point 290 (i.e., another device) may be located inside the LOS coverage of wireless device 210. Wireless device 210 can transmit a signal to access point 290 via a line-of-sight (LOS) path 252. Another access point 292 may be located outside the LOS coverage of wireless device 210. Wireless device 210 can transmit a signal to access point 292 via a non-line-of-sight (NLOS) path 254, which includes a direct path 256 from wireless device 210 to a wall 280 and a reflected path 258 from wall 280 to access point 292.

In general, the wireless device 210 may transmit a signal via a LOS path directly to another device located within antenna beam 250, e.g., as shown in FIG. 2. This signal may have a much lower power loss when received via the LOS path. The low power loss may allow wireless device 210 to transmit the signal at a lower power level, which may enable wireless device 210 to conserve battery power and extend battery life.

The wireless device 210 may transmit a signal via a NLOS path to another device located outside of antenna beam 250, e.g., as also shown in FIG. 2. This signal may have a much higher power loss when received via the NLOS path, since a large portion of the signal energy may be reflected, absorbed, and/or scattered by one or more objects in the NLOS path. Wireless device 210 may transmit the signal at a high power level in an effort to ensure that the signal can be reliably received via the NLOS path.

Figure 3:
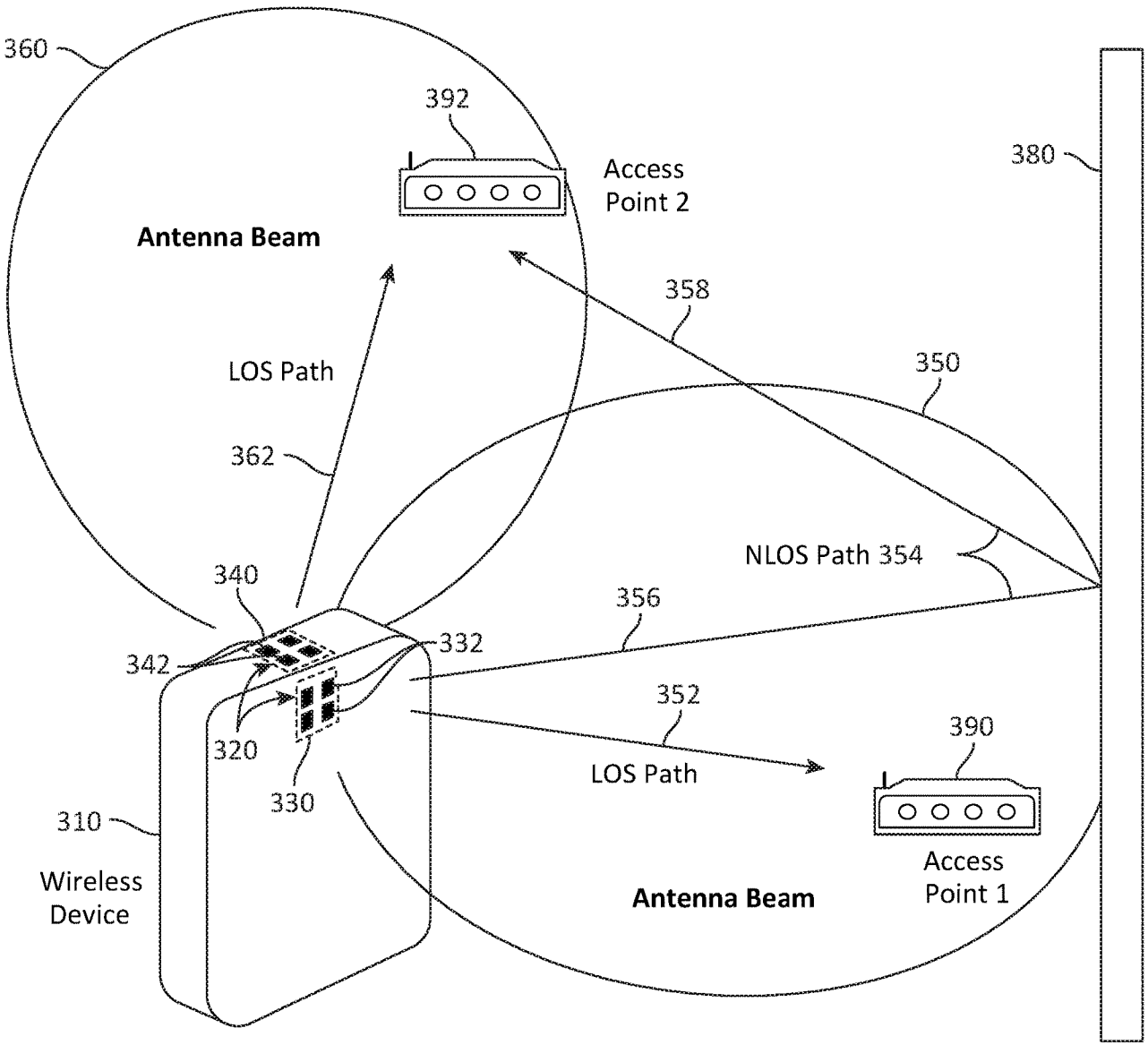
FIG. 3 shows a wireless device with a 3-dimensional (3-D) antenna system.

Referring to FIG. 3, an exemplary design of a wireless device 310 with a 3-D antenna system 320 is shown. In this exemplary design, antenna system 320 includes (i) a 2×2 array 330 of four patch antennas 332 formed on a first plane corresponding to the back surface of wireless device 310 and (ii) a 2×2 array 340 of four patch antennas 342 formed on a second plane corresponding to the top surface of wireless device 310. As depicted in FIG. 3, the second plane is at a 90 degree angle respective to the first plane. The 90 degree angle is exemplary only and not a limitation as other orientations between one or more antenna arrays maybe be used. The antenna array 330 has an antenna beam 350, which may be formed to point in a direction that is orthogonal to the first plane on which patch antennas 332 are formed or in a direction that is within a certain angle of orthogonal, for example up to 60 degrees in an direction from orthogonal. Antenna array 340 has an antenna beam 360, which points in a direction that is orthogonal to the second plane on which patch antennas 342 are formed in the illustrated embodiment. Antenna beams 350 and 360 thus represent the LOS coverage of wireless device 310. While the arrays 330 and 340 are each illustrated as a 2×2 array in FIG. 3, one or both may include a greater or fewer number of antennas, and/or the antennas may be disposed in a different configuration. For example, one or both of the arrays 330 and 340 may be configured as a 1×4 array.

An access point 390 (i.e., another device) may be located inside the LOS coverage of antenna beam 350 but outside the LOS coverage of antenna beam 360. Wireless device 310 can transmit a first signal to access point 390 via a LOS path 352 within antenna beam 350. Another access point 392 may be located inside the LOS coverage of antenna beam 360 but outside the LOS coverage of antenna beam 350. Wireless device 310 can transmit a second signal to access point 392 via a LOS path 362 within antenna beam 360. Wireless device 310 can transmit a signal to access point 392 via a NLOS path 354 composed of a direct path 356 and a reflected path 358 due to a wall 380. Access point 392 may receive the signal via LOS path 362 at a higher power level than the signal via NLOS path 354.

The wireless device 310 shows an exemplary design of a 3-D antenna system comprising two 2×2 antenna arrays 330 and 340 formed on two planes. In general, a 3-D antenna system may include any number of antenna elements formed on any number of planes pointing in different spatial directions (including a single plane in which multiple antenna elements radiate in different directions). The planes may or may not be orthogonal to one another.

Figure 4:
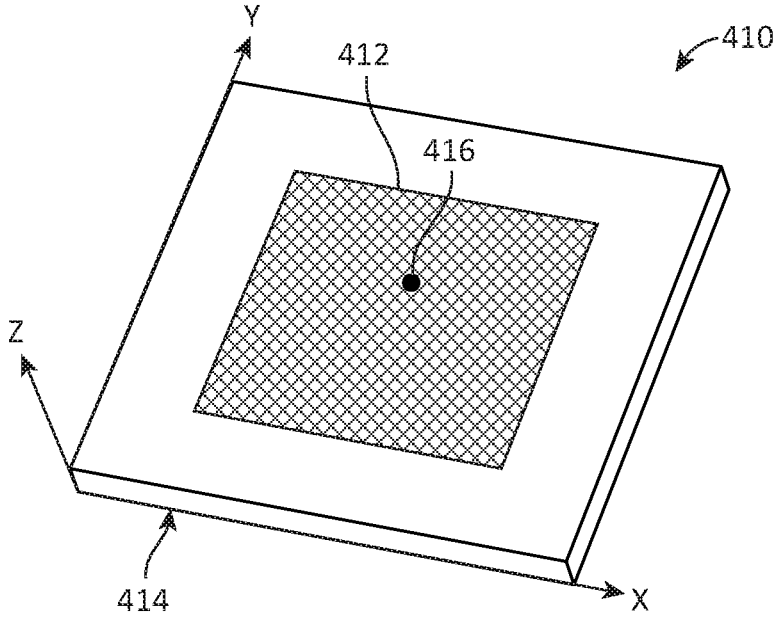
FIG. 4 shows an exemplary design of a patch antenna.

Referring to FIG. 4, an exemplary design of a patch antenna 410 suitable for MMW frequencies is shown. The patch antenna 410 includes a radiator such as a conductive patch 412 formed over a substrate 414. In an example, the patch 412 has a dimension (e.g., 5×5 mm) selected based on the desired operating frequency. The substrate 414 has a dimension (e.g., 10×10 mm). Smaller dimensions of patches and substrates may be used. In an example, a feedpoint 416 is located near the center of patch 412 and is the point at which an output RF signal is applied to patch antenna 410 for transmission. Multiple feed points may also be used to vary the polarization of the patch antenna 410. For example, at least two conductors may be used for dual polarization (e.g., a first conductor and a second conductor may be used for a horizontal-pol feed line and a vertical-pol feed line). The locations and number of the feedpoints may be selected to provide the desired impedance match to a feedline. Additional patches may be assembled in an array (e.g., 1×2, 1×3, 1×4, 2×2, 2×3, 2×4, 3×3, 3×4, etc. . . . ) to further provide a desired directivity and sensitivity.

Figure 5B:
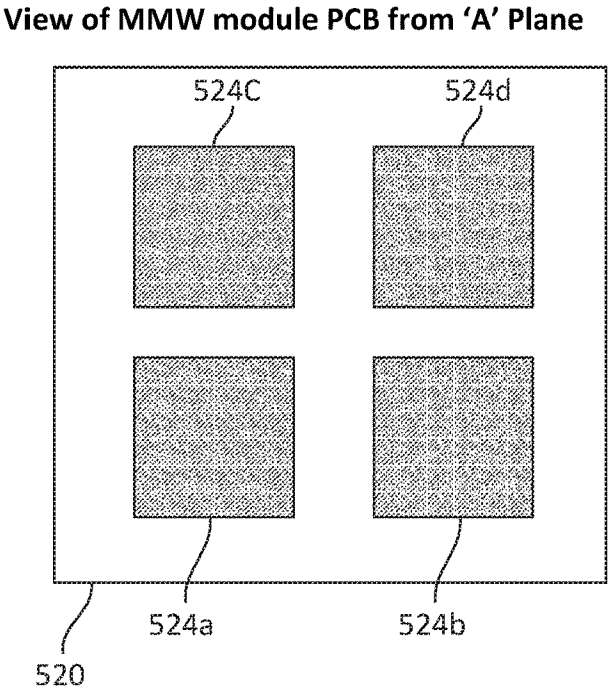
FIGS. 5A and 5B show a side view and top view of an example patch antenna array in a wireless device.
Figure 5A:
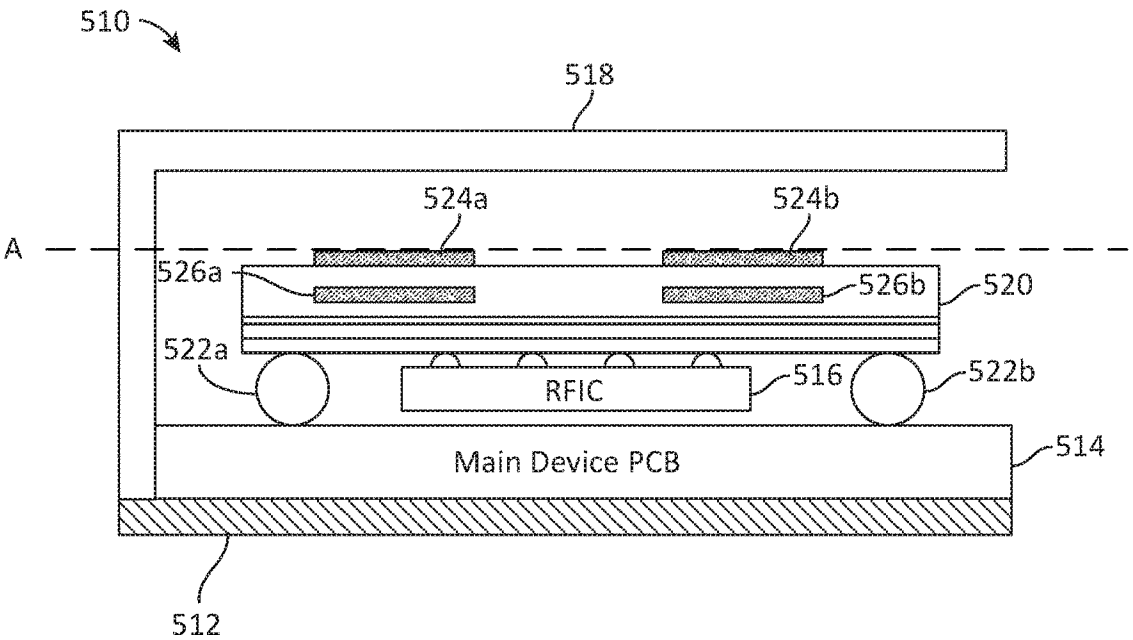

Referring to FIGS. 5A and 5B, a side view and top view of an example patch antenna array in a wireless device 510 is shown. The wireless device 510 includes a display device 512, a device cover 518, and a main device printed circuit board (PCB) 514. The device cover 518 is typically made of a plastic material such as polycarbonate or polyurethane. In some devices, the cover may be constructed of a glass or a ceramic structure. Other non-conductive materials are also used for device covers. A MMW module PCB 520 is operably coupled to the main device PCB 514 via one or more ball grid array (BGA) conductors 522*a-b*. The MMW module PCB 520 may include a plurality of patches 524*a-d* and corresponding passive patches 526*a-b* to form a wide-band antenna. In general, a stack of patches (e.g., 524*a*, 526*a*) may include an actively driven element and one or more passive or parasitic elements. The MMW module PCB 520 also includes signal and ground layers which further increase the thickness (e.g., height) of the PCB 520. An integrated circuit (RFIC) 516 is mounted to the MMW module PCB 520 and operates to adjust the power and the radiation beam patterns associated with the patch antenna array 524*a-d*. The RFIC 516 is an example of an antenna controller means. For example, the integrated circuit 516 may be configured to utilize phase shifters and/or hybrid antenna couplers to control the power directed to the antenna array and to control the resulting beam pattern, for example so as to drive the patches 524 as a phased array.

Figure 6A:
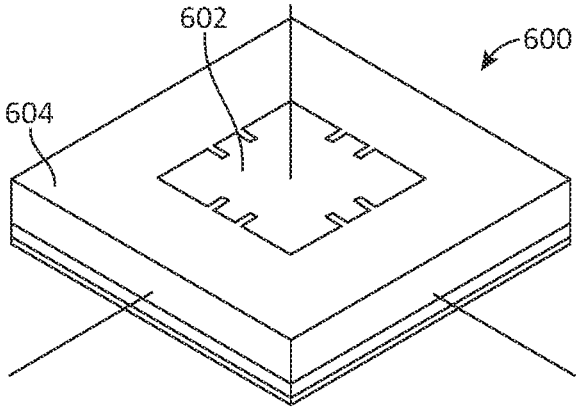
FIGS. 6A-6C show an example patch antenna mounted on substrates with different dielectric constants.
Figure 6B:
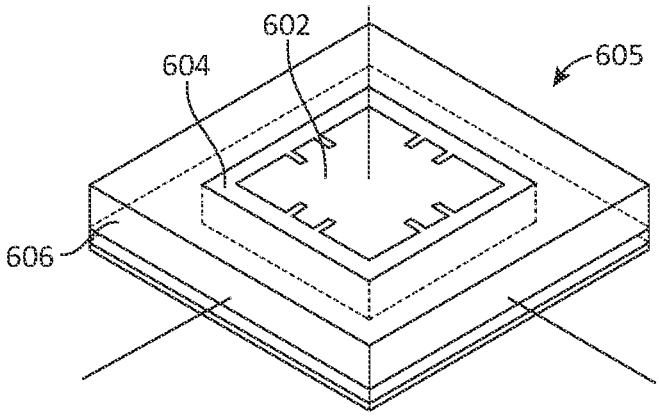
Figure 6C:
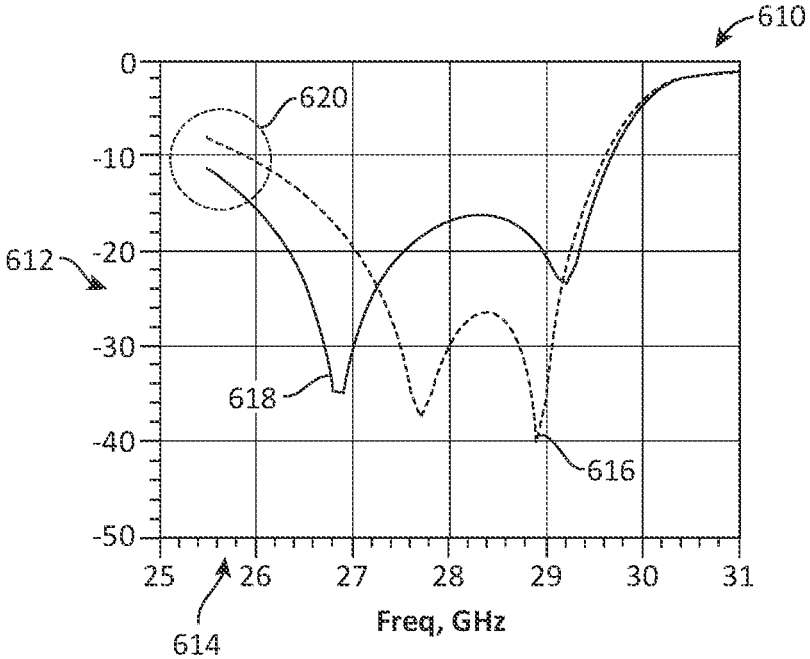

Referring to FIG. 6A, a uniform substrate patch antenna 600 includes a metallic patch 602 disposed in a first area on a first substrate 604. In an example, the first substrate 604 may be a PCB material such as FR-4, BT, FR-5, etc., with a first dielectric constant (e.g., 4.15, 3.6, 3.43 at 1-10 GHz). The PCB material is an example only and not a limitation as other substrates with different dielectric constants may be used. In general, the dielectric constant of the substrate around an antenna structure may impact the performance of the antenna. Referring to FIG. 6B, for example, a mixed substrate patch antenna 605 includes the metallic patch 602 disposed in a first area on the first substrate 604. The metallic patch 602 and the first substrate 604 are surrounded by a second area comprising a second substrate 606. The dielectric constant of the second substrate 606 is different from the dielectric constant of the first substrate 604. In an example, the dielectric constant of the first substrate 604 is 3.6 and the dielectric constant of the second substrate 606 is 4.5. Referring to FIG. 6C, a frequency response graph 610 relating to the patch antennas in FIG. 6A and FIG. 6B is shown. The graph 610 includes a signal strength axis 612 (in dB) and a radio frequency axis 614 (in GHz). A first data set 616 indicates the frequency response of the uniform substrate patch antenna 600, and a second data set 618 indicates the frequency response of the mixed substrate patch antenna 605. A comparison highlight area 620 is provided to demonstrate the bandwidth enhancement realized by the mixed substrate patch antenna 605. Specifically, the mixed dielectric substrate increases the antenna S11 (e.g., standing wave ratio) at less than −10 dB for a wider frequency range as compared to a uniform substrate patch antenna. The frequency response curves (e.g., the first data set 616, and the second data set 618) are examples only and may change with different dielectric values as well as different substrate and patch geometries.

Figure 7:
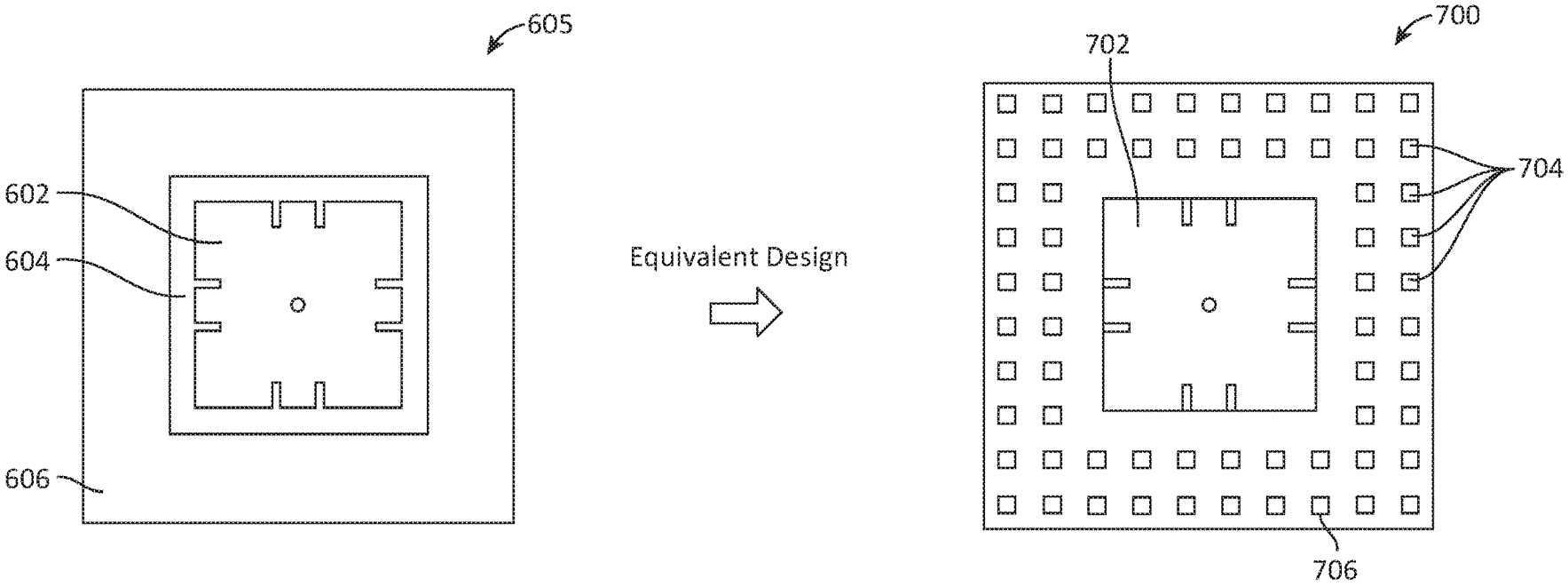
FIG. 7 shows an example of a substrate with metamaterial structures.

Referring to FIG. 7, an example substrate 700 with metamaterial structures is shown. The substrate 700 includes a metallic patch 702 disposed in a first area of a dielectric substrate 706, and a plurality of metamaterial structures 704 disposed on and/or within a second area of the dielectric substrate 706 (e.g., FR-4, BT, FR-5, etc.). The second area of the substrate 706 surrounds the first area of the substrate 706 and is within the near field of the metallic patch 702. In some embodiments, the term "surround" may be used to refer to a configuration which is not fully enclosed, while in other embodiments the term "surround" refers to a configuration that fully encloses another portion or area. The metallic patch 702 may be a square metal patch or other type of radiator such as a strip antenna. The metamaterial structures 704 may be small metallic structures (e.g., squares, crosses, circles, etc.) disposed in the near field of the metallic patch 702 in a periodic pattern. In general, the term near field means a region in the immediate vicinity of a radiating antenna that is not the far field of the antenna. A definition of the near field may include the region in which the energy radiated from the antenna is predominately a reactive field (e.g., the E- and H-fields are out of phase with one another). The dimensions (e.g., maximum width) of the metamaterial structures 704 are electrically small in physical size as compared to the wavelength of the operational frequency of the metallic patch 702. A periodic pattern may be defined as a repeating pattern of metamaterial structures on a single plane of a substrate with each metamaterial structure being a neighbor to at least two other metamaterial structures on two axes, the distances to each of the neighboring metamaterial structures being approximately equal. The dielectric constant of a portion of the substrate on or in which the metamaterials are formed may be increased due to the presence of the periodic pattern of metamaterial structures. In an example, the maximum width of each of the metamaterial structures is less than half of a wavelength of the operational frequency. The dimensions and/or period of the positions of the metamaterial structures 704 may be varied to change the dielectric constant of the PCB substrate 706. The example substrate 700 provides similar bandwidth enhancements as the mixed substrate patch antenna 605. That is, the metamaterial structures 704 effectively change the dielectric constant of the PCB substrate 706 in the areas the metamaterial structures 704 are disposed. The net electrical result of including the metamaterial structures is similar to the results achieved by using the second dielectric constant of the second substrate 606 in the mixed substrate patch antenna 605.

Figure 8:
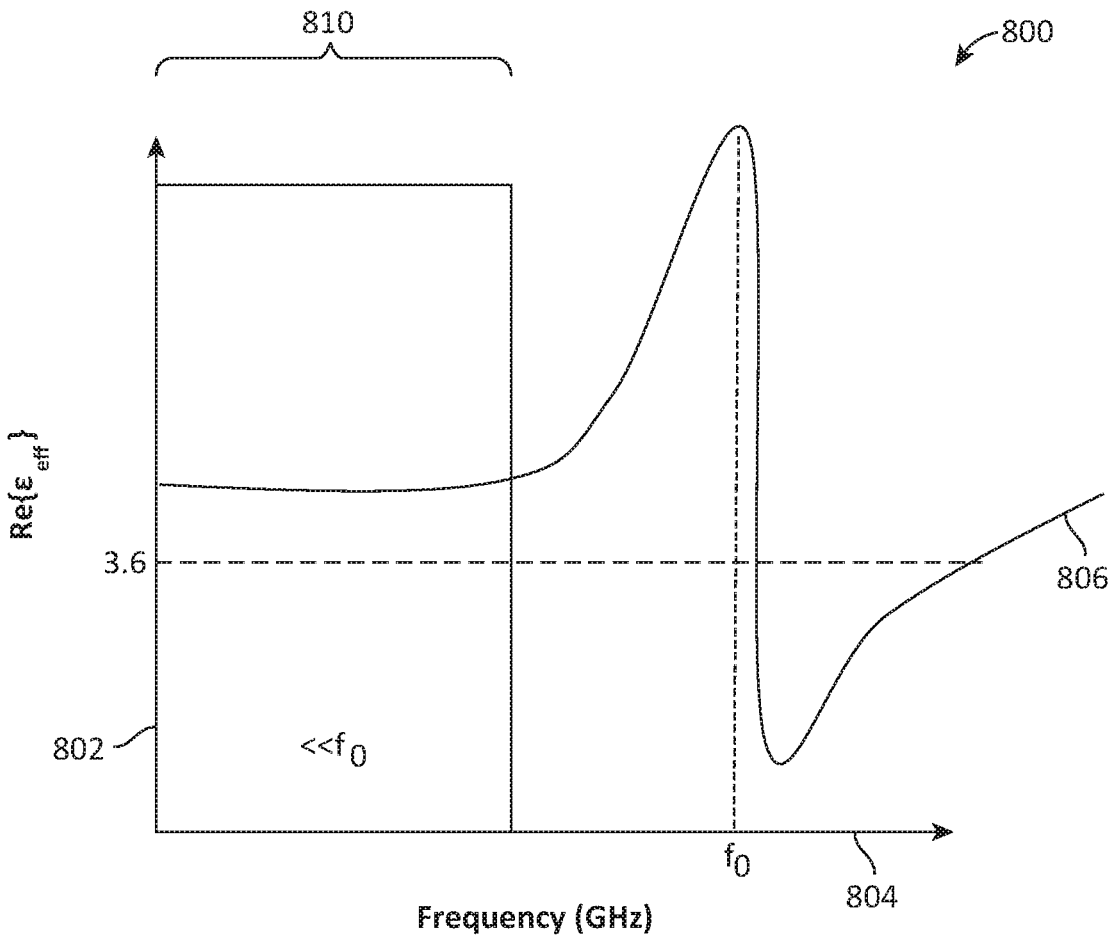
FIG. 8 is a frequency response graph of an example metamaterial structure.

Referring to FIG. 8, a frequency response graph 800 of an example metamaterial structure is illustrated. The graph 800 includes a resistance/reactance axis 802, a frequency axis 804, a frequency response curve 806 and a stable operation region 810. The graph 800 represents an example frequency response of an example metamaterial structure (e.g., a individual small metal structure such as one of the metamaterial structures 704). The metamaterial structure resonates at a first resonant frequency $f_0$. At frequencies less than the first resonant frequency (e.g., $<<f_0$), the frequency response is approximately flat as depicted in the stable operation region 810. The metamaterial structures described herein are designed to operate within the stable operation region 810 for transmission/reception frequencies of the patch 702 (or other radiator which is disposed near the metamaterial structure). For example, the dimensions of the metamaterial structures are typically in a range of $1/5^{th}$ to $1/20^{th}$ the size of the wavelength of the frequency of the antenna radiator.

Figure 9A:
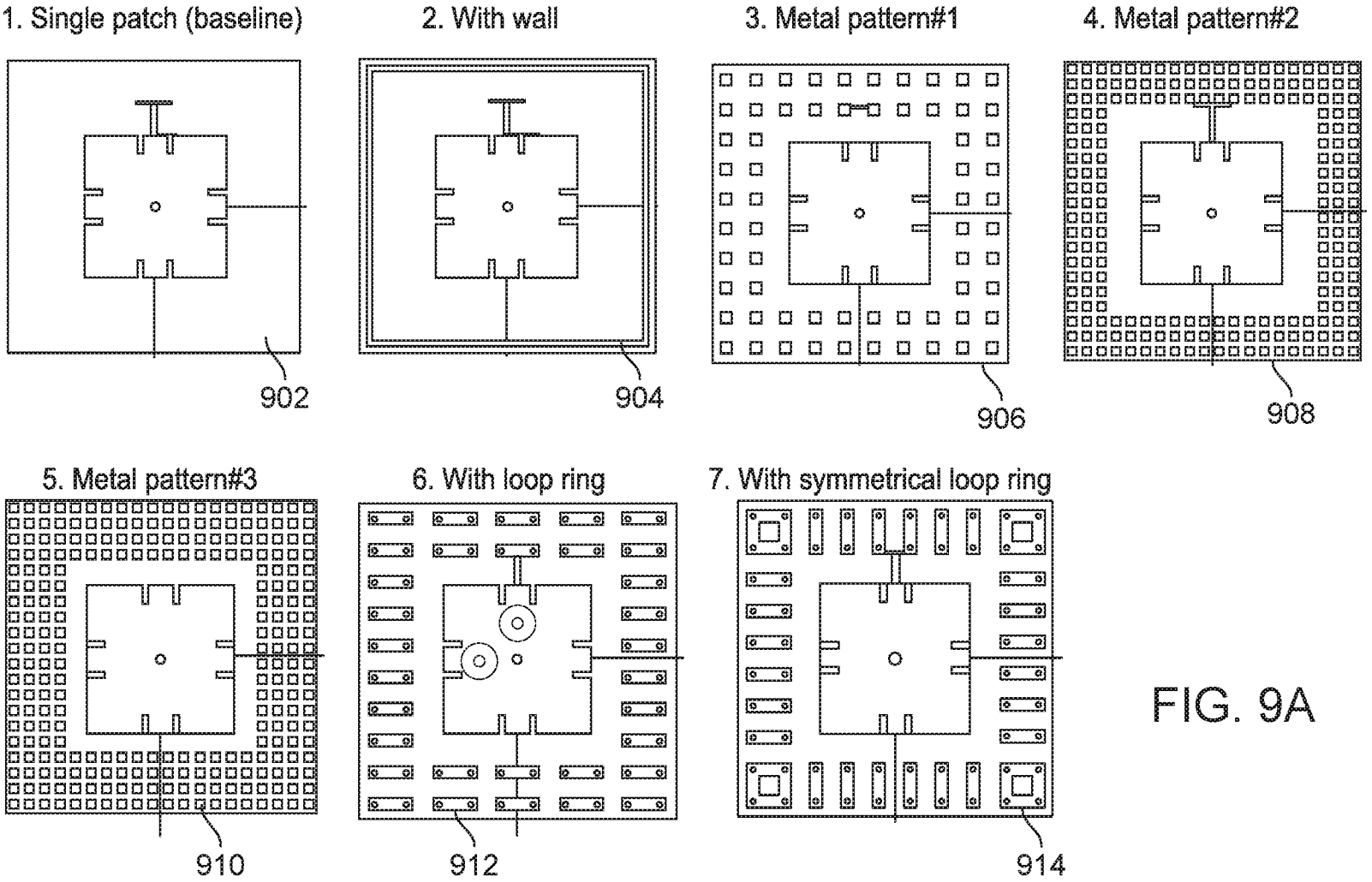
FIG. 9A shows a patch antenna with examples of different metamaterial structures.

Referring to FIG. 9A, a patch antenna with examples of different metamaterial structures are shown. FIG. 9A provides a general overview of different metamaterial structures and FIGS. 10A-10F provide more detailed views of the embodiments. While the metal structures in FIG. 9A are generally depicted as squares, other geometric shapes (e.g., circles, rectangles, polygons, etc.) may be used. A single patch baseline antenna 902 is an example of a uniform substrate patch antenna 600 as described in FIG. 6A including a metallic patch and a first substrate. The single patch baseline antenna 902 provides reference bandwidth performance as comparison for the example antenna designs depicted in FIG. 9A. A patch antenna with a wall 904 includes a single metal patch and a uniform substrate surrounded by a continuous metal wall. A patch antenna with a first metal pattern 906 includes a single patch with a metamaterial including two concentric perimeters (e.g., rings) of metal structures disposed on or in a substrate around the patch. A patch antenna with a second metal pattern 908 includes a single patch with a metamaterial including three concentric perimeters of metal structures disposed on or in a substrate around the patch. A patch antenna with a third metal pattern 910 includes a single patch with a metamaterial including four concentric perimeters of metal structures disposed on or in a substrate around the patch. A patch antenna with loop rings 912 includes a single patch with a metamaterial including a plurality of metallic loop rings disposed in a substrate around the patch. A patch antenna with symmetrical loop rings 914 includes a single patch with a metamaterial including a plurality of symmetric metallic loop rings disposed in a substrate around the patch. As depicted in Table 1 below, the example patch antennas depicted in FIG. 9A provide different bandwidth performance and different metal density values.

TABLE 1

| Antenna Configuration | S11 < −10 dB (GHz) | Fractional Bandwidth (FBW) | Metal Density (%) |
|---|---|---|---|
| Single patch 902 | 26~29.6 | 12.9 | 23 |
| With wall 904 | 26.5~29.7 | 11.4 | 25.5 |
| With first metal pattern 906 | 25.6~29.9 | 15.5 | 32.7 |
| With second metal pattern 908 | 25.8~29.9 | 14.7 | 40.8 |
| With third metal pattern 910 | 25.5~30.4 | 17.5 | 46.9 |
| With loop ring 912 | 25.6~30.9 | 18.8 | 38.5 |

Figure 9B:
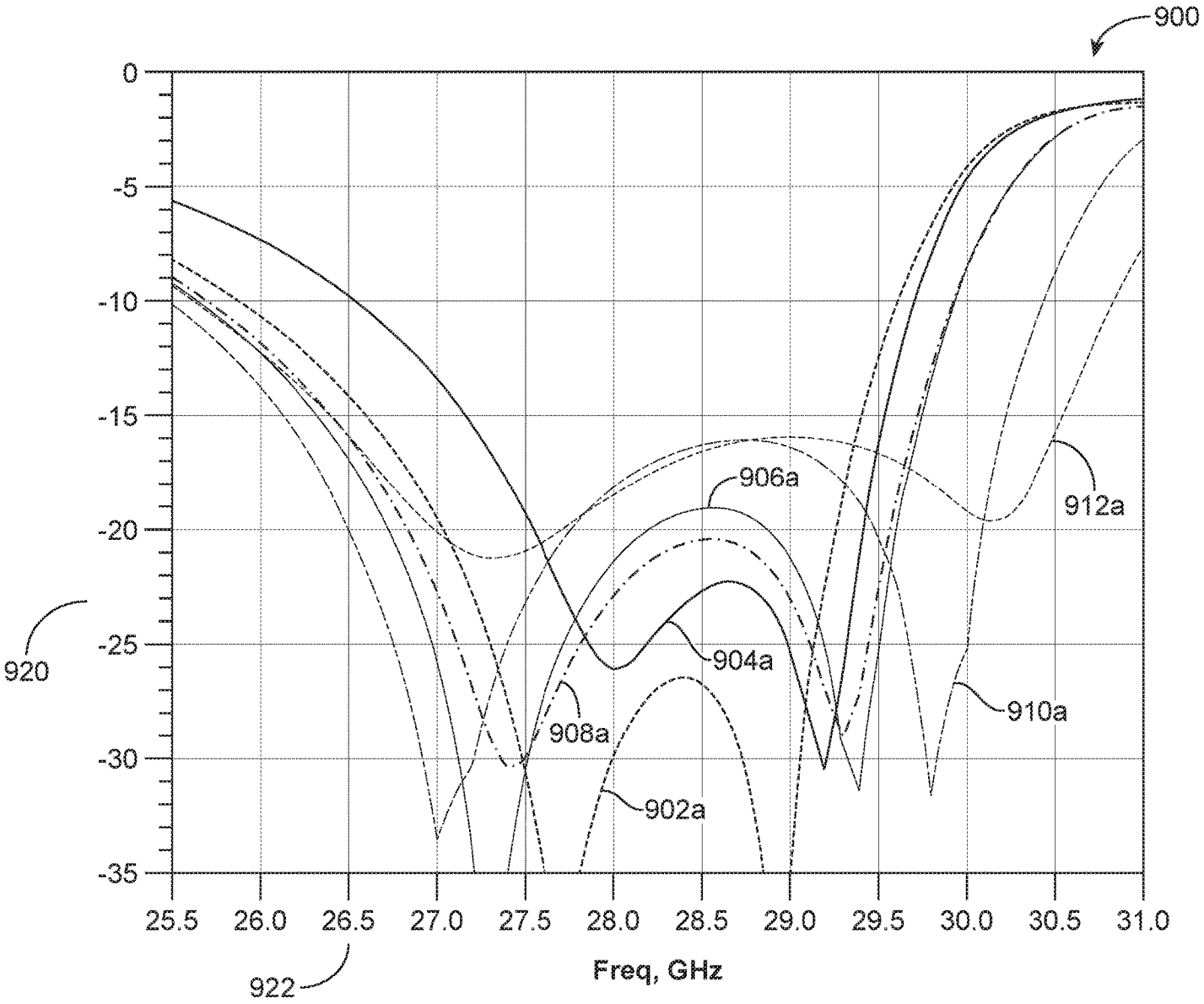
FIG. 9B is a graph depicting antenna bandwidth performance for each of the examples depicted in FIG. 9A.

Referring to FIG. 9B, a frequency response graph 900 depicting the antenna bandwidth performance for each of the examples depicted in FIG. 9A is shown. The graph 900 includes a signal strength axis 920 (in dB) and a frequency axis 922 (in GHz). The graph 900 includes a plurality of response curves associated with the designs depicted in FIG. 9A and are the basis for the bandwidth performance provided in Table 1. In an example, the response curves may be generated with a modeling software such as High Frequency Simulation Software (HFSS) from Ansys, Inc. For example, a first response curve 902*a* is based on the performance of the single patch baseline antenna 902. A second response curve 904*a* is based on the patch antenna with a wall 904. A third response curve 906*a* is based on the patch antenna with a first metal pattern 906. A fourth response curve 908*a* is based on the patch antenna with a second metal pattern 908. A fifth response curve 910*a* is based on the patch antenna with a third metal pattern 910. A sixth response curve 912*a* is based on the patch antenna with loop rings 912.

Figure 10A:
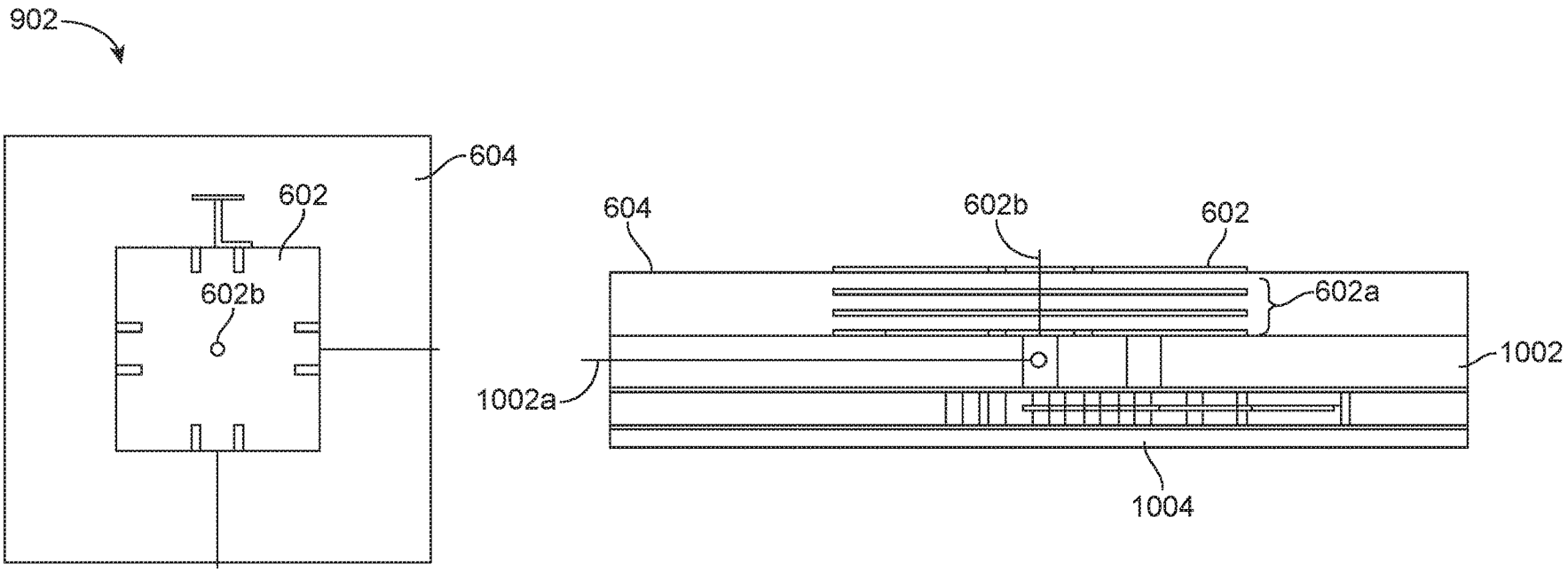
FIGS. 10A-10F are illustrations of example patch antenna and metamaterial configurations.

Referring to FIGS. 10A to 10F, illustrations of the example patch antennas depicted in FIG. 9A are shown with at least a top view and a side view. The patch antennas are examples only as other configurations of radiators and metamaterial may be used to enhance the bandwidth of an antenna system. Further, while the examples in FIGS. 10A to 10F show four metal layers, fewer layers (e.g., only one layer) or additional layers may be used. Referring to FIG. 10A, a top view and side view of the single patch baseline antenna 902 are shown. The single patch baseline antenna 902 includes the metallic patch 602 and the first substrate 604. The first substrate 604 may include one or more additional metallic patches 602*a*. For example, as depicted in 10A, the metallic patch 602 is an active radiator and receives an input from a feedline 602*b*. The additional metallic patches 602*a* may be passive (e.g., parasitic) radiators. In an embodiment, antenna polarization may be realized by providing an additional feed signal to the metallic patch 602 or one of the additional metallic patches 602*a*. The first substrate 604 may include a feed layer 1002 including at least one feedline 1002*a* configured to provide an RF signal to the metallic patch 602. The first substrate 604 may also include an interconnect layer 1004 configured to operably couple the antenna 902 to a MMW module PCB 520, an RFIC 516, or other circuits and devices as required in a wireless communications device.

Figure 10B:
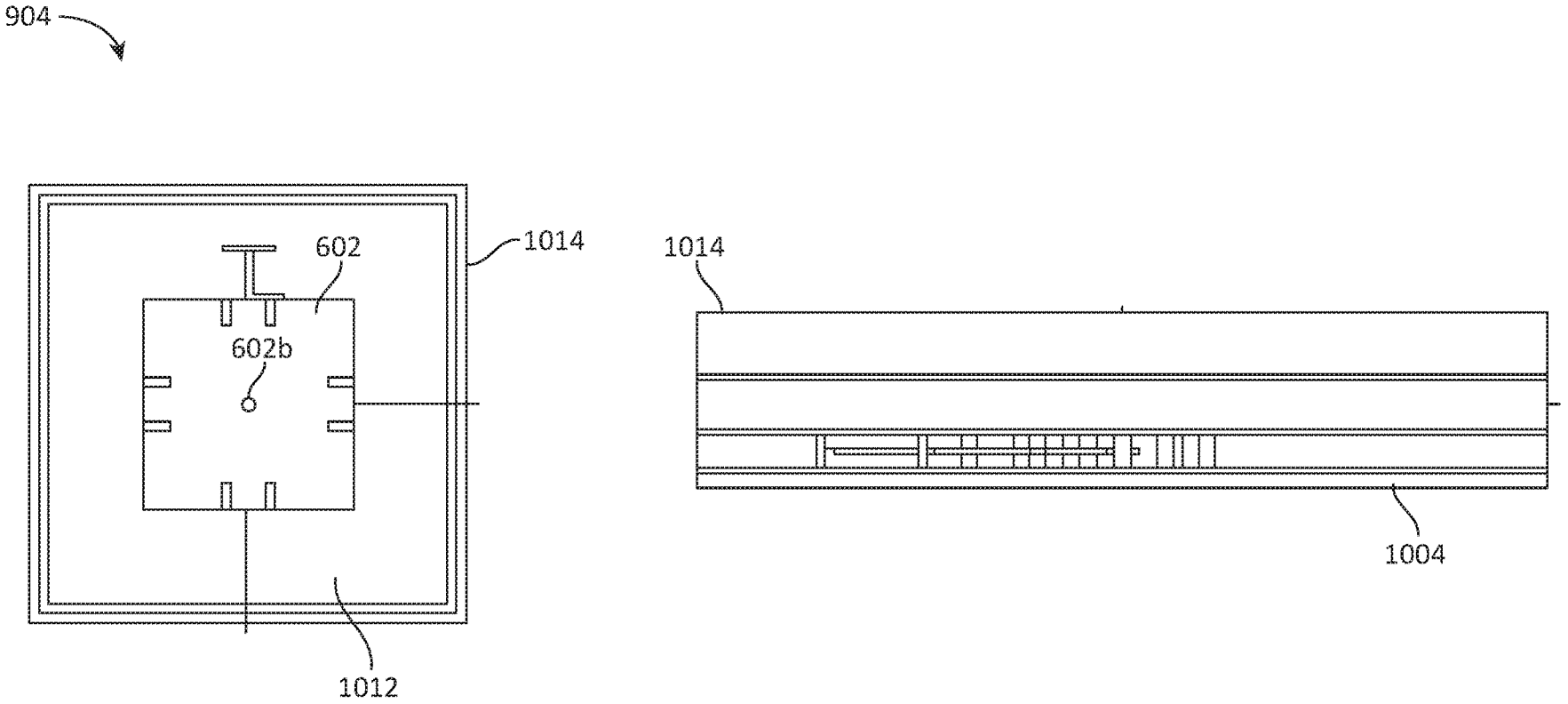

Referring to FIG. 10B, a top view and a side view of a patch antenna with a wall 904 are shown. The antenna 904 includes a metallic patch 602 operably coupled to a feedline 602*b*. The metallic patch 602 is disposed on a PCB substrate 1012. A solid metallic wall 1014 is disposed around the metallic patch 602 and the PCB substrate 1012. In an example, the wall 1014 may be approximately 0.1-0.5 mm thick with a height equal to the width of the PCB substrate 1012. In other embodiments, the wall may instead be formed of a plurality of vias. The PCB substrate 1012 may include a feed layer (not shown in FIG. 10A) and the interconnect layer 1004. Additional parasitic or active radiators may also be included within the PCB substrate 1012.

Figure 10C:
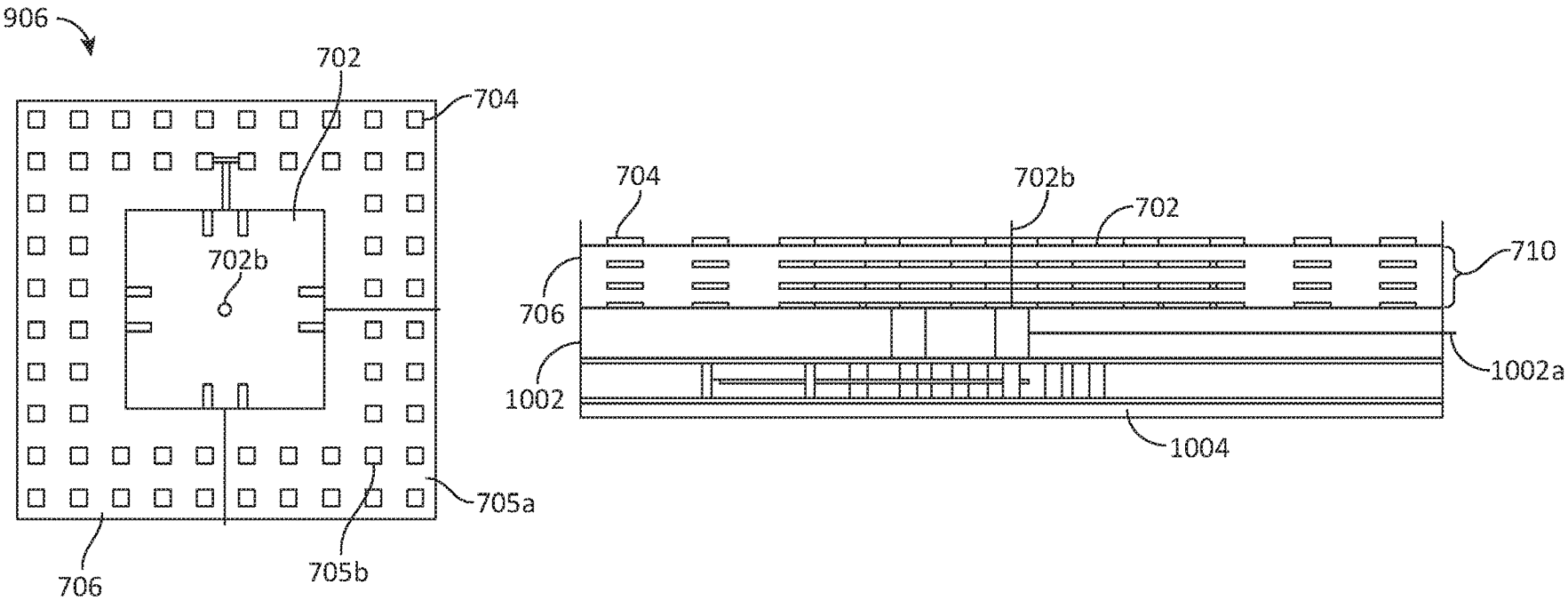

Referring to FIG. 10C, a top view and a side view of a patch antenna with a first metal pattern 906 are shown. The antenna 906 includes a metallic patch 702 operably coupled to a feedline 702*b*. The metallic patch 702 and a plurality of metamaterial structures 704 are disposed on and within a PCB substrate 706. In an example, the metallic patch 702 is approximately 5 mm in length and 5 mm in width (e.g. +/−10%) and may be deposited in a PCB manufacturing process such as High Density Interconnect (HDI) or other such sequential lamination processes. Each of the plurality of metamaterial structures 704 may be approximately 0.1 to 0.15 mm in length and width (e.g., +/−10%) and may be deposited during the manufacturing process. In general, the spacing between each of the metamaterial structures 704 are kept at approximately equal values to form a periodic pattern. For example, the metamaterial structures 704 are arranged in two concentric perimeters around the metallic patch 702. A first concentric perimeter 705*a* includes equally spaced metamaterial structures 704 around the exterior boundary of the PCB substrate 706, and a second concentric perimeter 705*b* includes equally spaced metamaterial structures 704 inside of the first concentric perimeter 705*a* as shown in FIG. 10C. The spacing between the first concentric perimeter 705*a* and the second concentric perimeter 705*b* is equal to the spacing between the metamaterial structures 704 on either of the concentric perimeters 705*a-b*. The period and size of the metamaterial structures 704 may be varied to change the dielectric constant of the PCB substrate 706. In addition to repeating the pattern in the x-y plane, as indicated in FIG. 10C, the pattern is repeated along the z-axis such that more than one plane within the PCB substrate 1012 may include a metallic patch and a plurality of metamaterial structures. For example, both the metallic patch 702 and the plurality of metamaterial structures 704 are repeated three times at equal intervals throughout the depth 710 of the PCB substrate 706. The additional metallic patches within the depth 710 of the PCB substrate 706 may be passive radiators or may be configured to receive an RF signal (i.e., active radiator). The PCB substrate may include a feed layer 1002, such as a microstrip line 1002*a*, which includes a feedline 702*b* that is operably coupled to the metallic patch 702 with one or more via connects. In an example, an additional feedline may be coupled to the metallic patch 702 or one of the additional metallic patches within the PCB substrate 706 to provide dual polarization capabilities.

Figure 10D:
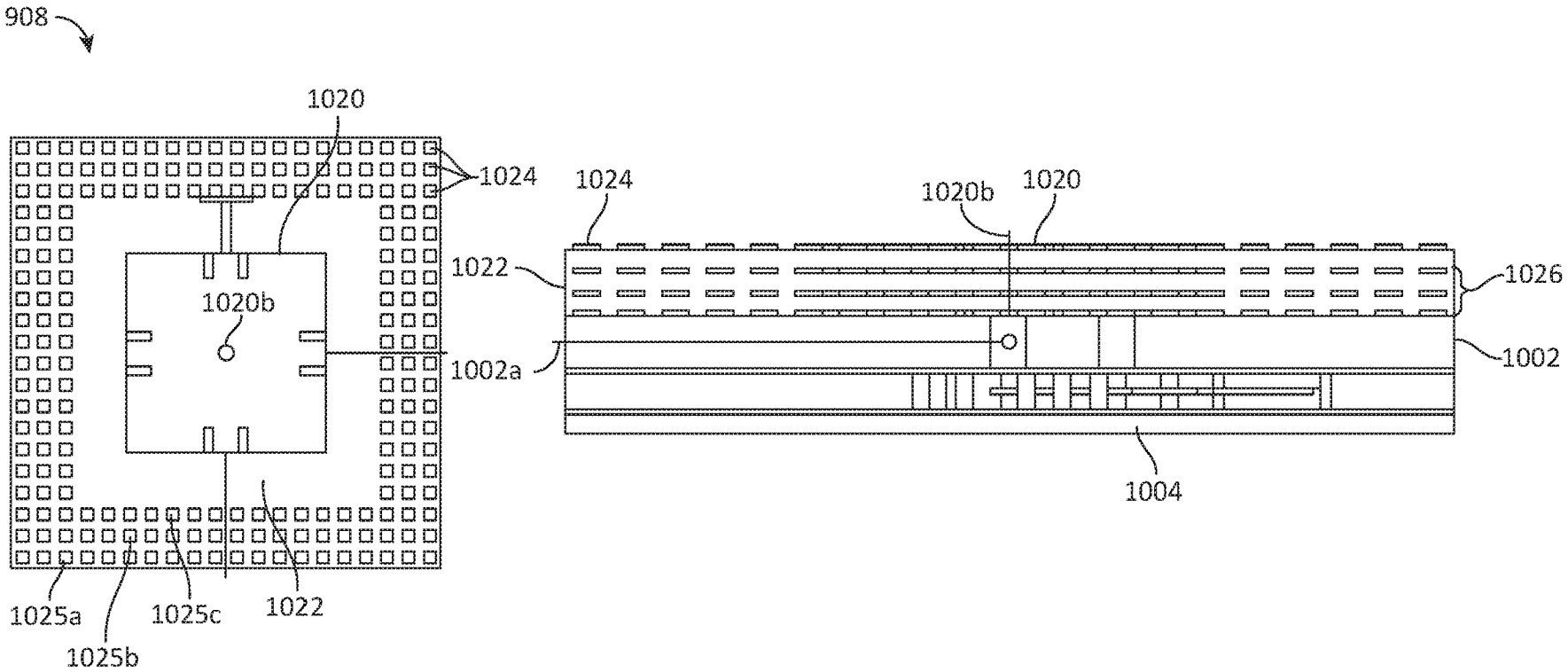

Referring to FIG. 10D, a top view and a side view of a patch antenna with a second metal pattern 908 are shown. The antenna 908 includes a metallic patch 1020 operably coupled to a feedline 1020*b*. The metallic patch 1020 and a plurality of metallic metamaterial structures 1024 are disposed on and within a PCB substrate 1022. In an example, the metallic patch 1020 is approximately 5 mm in length and 5 mm in width (e.g. +/−10%) and each of the plurality of metallic metamaterial structures 1024 may be approximately 0.08 to 0.12 mm in length and width (e.g., +/−10%). The metallic patch 1020 and plurality of metallic metamaterial structures 1024 may be deposited during the manufacturing process. The spacing between each of the metallic metamaterial structures 1024 are kept at approximately equal values to form a periodic arrangement. As an example, the metallic metamaterial structures 1024 are arranged in a periodic pattern including three concentric perimeters 1025*a-c* around the metallic patch 1020. As depicted in FIG. 10D, the pattern of the metallic metamaterial structures 1024 may also be repeated at equal vertical intervals within the PCB substrate 1022. For example, the interior portion 1026 of the PCB substrate 1022 comprises three layers, with each layer including both a metallic patch 1020 and a plurality of metallic metamaterial structures 1024. The additional metallic patches in the interior portion 1026 may be passive radiators or may be configured to receive an RF signal (i.e., active radiator). The PCB substrate may include a feed layer 1002, such as a microstrip line 1002*a*, which includes a feedline 1020*b* that is operably coupled to the metallic patch 1020 with one or more via connects. In an example, an additional feedline may be coupled to the metallic patch 1020 or one of the additional metallic patches within the PCB substrate to provide dual polarization capabilities. In an example, the bottom metallic patch in the interior portion 1026 is operably coupled to a feedline.

The dimensions, shape and patterns of the metallic patch 1020 and metallic metamaterial structures 1024 are examples only and not limitations. Other dimensions, shapes and patterns may be used to enhance the bandwidth performance of an antenna system. For example, the metamaterial structures may be in one pattern on one side of the metal patch and a different pattern on another side of the metal patch. Variations in the dimensions, shapes and/or patterns of the metal patch and metamaterial structures may be used to increase gain/directivity of an antenna system. In general, the addition of the metamaterial structures to the PCB substrate may provide antenna bandwidth enhancements when the physical size of the individual metamaterial structures is smaller than the wavelength of the operational frequency of the antenna (i.e., within the stable operation region 810), and the metamaterial structures are disposed in a periodic pattern on and/or within the PCB substrate. The addition of the metallic metamaterial structures also provides the advantage of increasing the metal density of an antenna system which may be beneficial to PCB construction because it can reduce warpage in the antenna assembly.

Figure 10E:
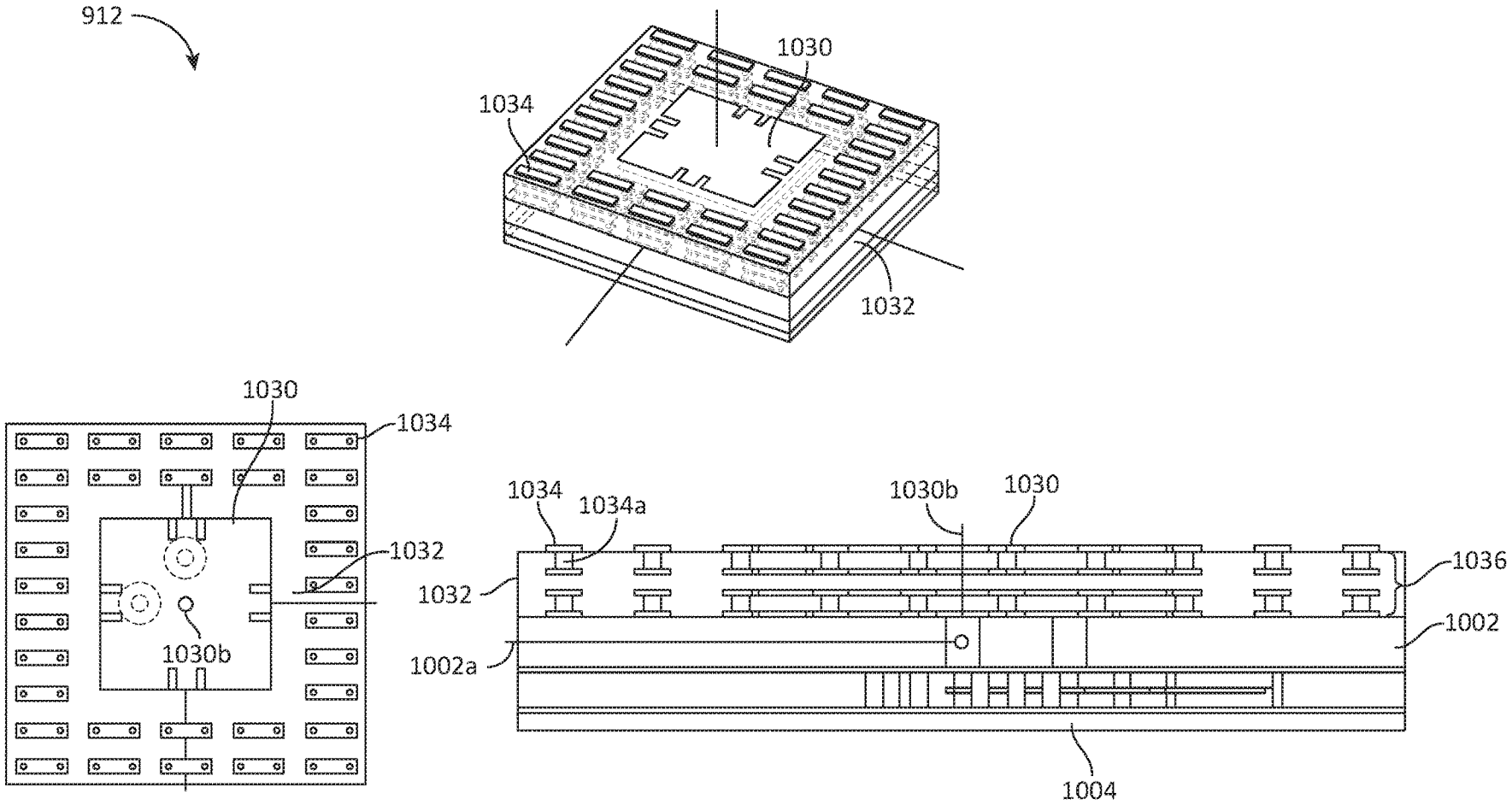

Referring to FIG. 10E, a top view, a side view and a perspective view of a patch antenna with loop rings 912 are shown. The antenna 912 includes a metallic patch 1030 operably coupled to a feedline 1030*b*. The metallic patch 1030 and a plurality of metallic metamaterial structures 1034 are disposed on and within a PCB substrate 1032. In an example, the metallic patch 1030 is approximately 5 mm in length and 5 mm in width (e.g. +/−10%) and each of the plurality of metallic metamaterial structures 1034 may be approximately 0.1 to 0.5 mm in width and 0.5 to 1.5 mm in length (e.g., +/−10%). The interior portion 1036 of the PCB substrate 1032 may include multiple layers with each layer including a metallic patch and a plurality of metallic metamaterial structures. One or more of the metallic metamaterial structures 1034 may be electrically coupled to a metamaterial structure in an adjacent layer with two conducting vias 1034*a* to form a conductive loop structure. For example, two metamaterial structures 1034 may form a top portion and a bottom portion of a loop ring, such that two conducting vias 1034*a* connect the respective ends of the metamaterial structures 1034 to form the ring structure. Thus, as depicted in FIG. 10E, four layers of metamaterial structures 1034 create two layers of loop rings within the PCB substrate 1032. The metallic patch 1030, the plurality of metallic metamaterial structures 1034, and the conducting vias 1034*a* may be deposited during the manufacturing process. The spacing between each of the metallic metamaterial structures 1034 are kept at approximately equal values to form a periodic arrangement. The PCB substrate 1032 may include four layers of metal patches 1030 as previously described. The PCB substrate 1032 may include a feed layer 1002, such as a microstrip line 1002*a*, which includes a feedline 1030*b* that is operably coupled to the metallic patch 1030 with one or more via connects. In an example, an additional feedline may be coupled to the metallic patch 1030 or one of the additional metallic patches within the PCB substrate to provide dual polarization capabilities. In an example, the bottom metallic patch in the interior portion 1036 is operably coupled to a feedline.

Figure 10F:
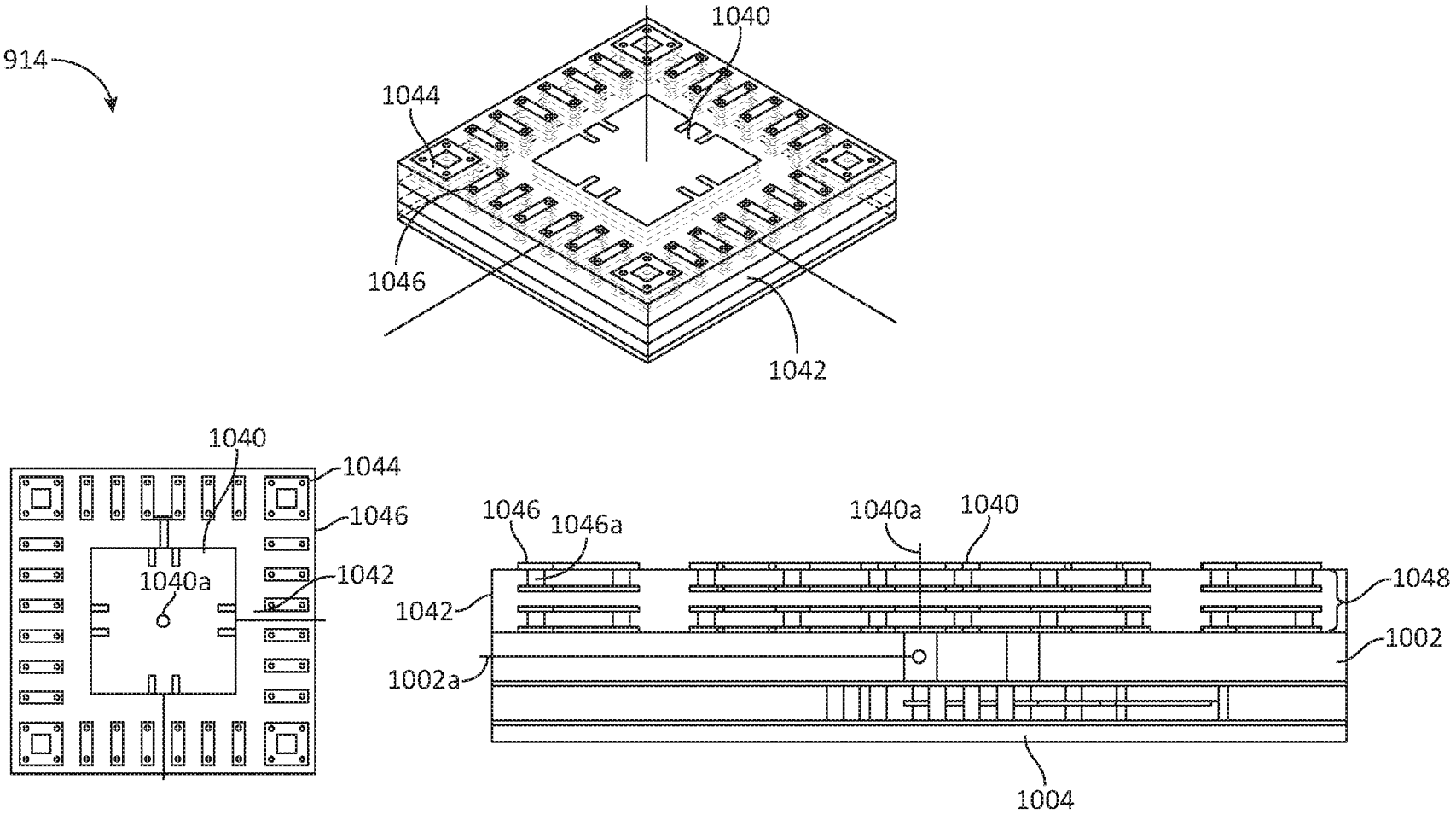

Referring to FIG. 10F, a top view, a side view and a perspective view of a patch antenna with symmetrical loop rings 914 are shown. The antenna 914 includes a metallic patch 1040 operably coupled to a feedline 1040*a*. The metallic patch 1040 and a plurality of metallic metamaterial structures 1044 are disposed on and within a PCB substrate 1042. In an example, the metallic patch 1040 is approximately 5 mm in length and 5 mm in width (e.g. +/−10%) and each of the plurality of metallic metamaterial structures 1044 may be approximately 0.1 to 0.5 mm in width and 0.5 to 1.5 mm in length (e.g., +/−10%). The interior portion 1048 of the PCB substrate 1032 may include multiple layers with each layer including a metallic patch and a plurality of metallic metamaterial structures. One or more of the metallic metamaterial structures 1044, 1046 may be electrically coupled to a metamaterial structure in an adjacent layer with two or more conducting vias 1046*a* to form a conductive loop structure. For example, two metamaterial structures 1046 may form a top portion and a bottom portion of a loop ring, such that two conducting vias 1046*a* connect the respective ends of the metamaterial structures 1046 to form the ring structure. The metallic metamaterial structures 1044 located in the corners of the antenna 914 are square-loop shaped and are coupled to an adjacent layer with four conducting vias 1046*a*. In an example, the square-loop shaped metamaterial structures 1044 may not be coupled to adjacent layers. As compared to the patch antenna with loop rings 912 depicted in FIG. 10E, the loop rings in the patch antenna with symmetrical loop rings 914 present a symmetric orientation relative to the metal patch 1040. The PCB substrate 1042 may include four layers of metal patches 1040 as previously described. The PCB substrate 1042 may include a feed layer 1002, such as a microstrip line 1002*a*, which includes a feedline 1040*a* that is operably coupled to the metallic patch 1030 with one or more via connects. In an example, an additional feedline may be coupled to the metallic patch 1040 or one of the additional metallic patches within the PCB substrate to provide dual polarization capabilities. In an example, the bottom metallic patch in the interior portion 1036 is operably coupled to a feedline.

Figure 11:
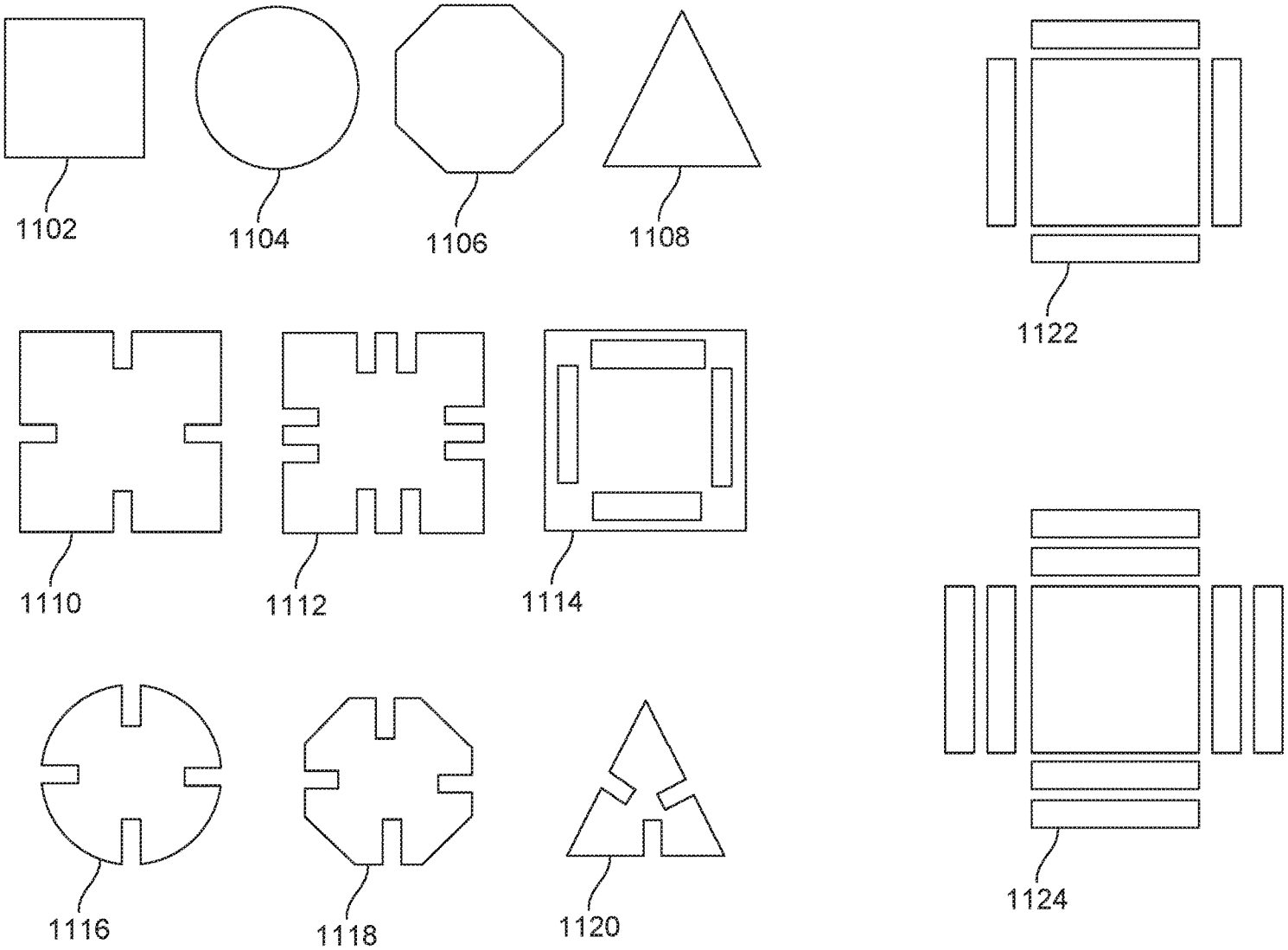
FIG. 11 provides examples of patch antenna geometries.

Referring to FIG. 11, with further references to FIGS. 10A-10F, examples of metal patch geometries are shown. In general, the size and shape of a metal patch radiator may be varied based on frequency, bandwidth and beam forming requirements. This geometry of the metal patches previously described are examples only and not limitations as other radiator shapes and configurations may be used. For example, a patch antenna array may be comprised of one or more patches including shapes such as a square patch 1102, a circle patch 1104, an octagon patch 1106, and a triangle patch 1108. Other shapes may also be used, and an antenna array may include patches with differing shapes. The properties of a patch antenna may be varied by changing the boundaries of the individual patches. For example, a square patch with single notches 1110, a square patch with multiple notches 1112 such as depicted in FIGS. 10A-10F, and a square with parallel notches 1114 may be used as a radiator. The square patch geometry is an example only and not a limitation as other shapes may include one or more notches such as a circle with notches 1116, an octagon with notches 1118, and a triangle with notches 1120. The shape and locations of the notches may vary. For example, the notches may be semicircles, triangles, or other shaped areas of material that are removed from the patch. A patch antenna may include one or more parasitic radiators disposed in proximity to the patch. For example, a patch with one set of parasitic radiators 1122 and a patch with two sets of parasitic radiators 1124 may be used. The metamaterial structures may be disposed around the combination of the patch and the parasitic radiators. The geometry, number, and locations of the parasitic radiators may vary based on antenna performance requirements.

Figure 12C:
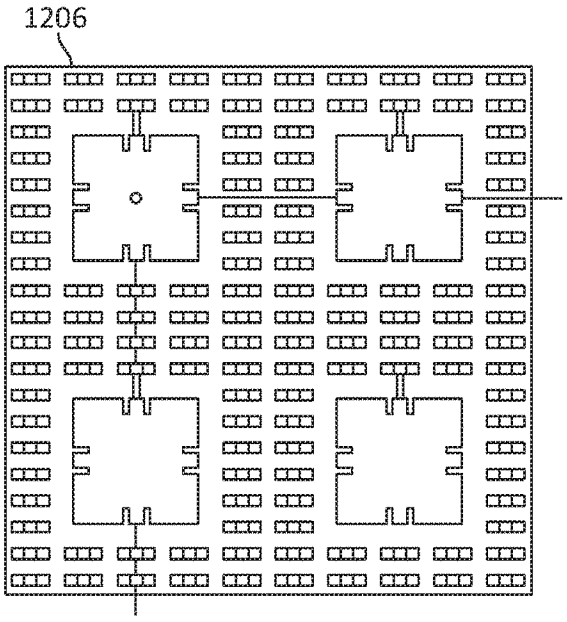
FIGS. 12A-12C provide example antenna arrays with different metamaterial structures.
Figure 12B:
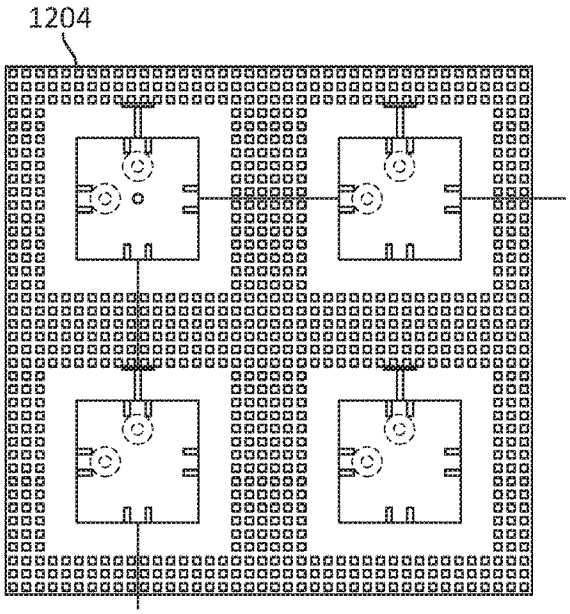
Figure 12A:
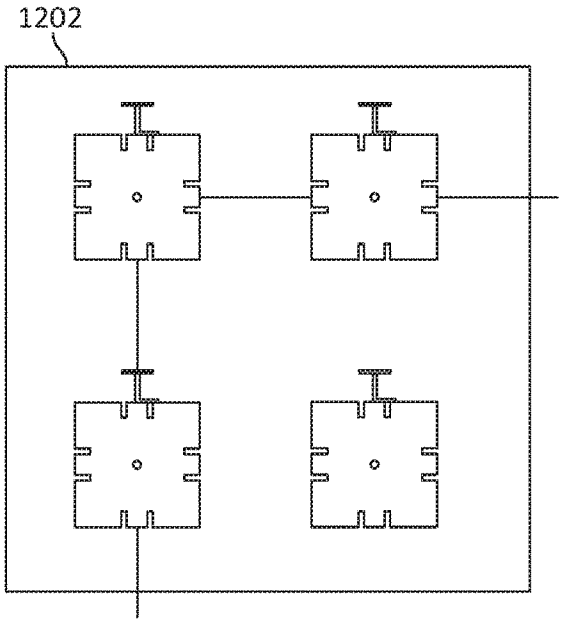

Referring to FIGS. 12A-12C, with further reference to FIG. 10A-10F, examples of antenna arrays with different metamaterial structures are shown. A first antenna array 1202 includes a plurality of metal patches on a uniform substrate. The first antenna array 1202 is comprised of four single patch baseline antennas 902 in a 2×2 array. The first antenna array 1202 provides a baseline by which bandwidth improvements of arrays with metamaterial structures may be measured. The example single metal patch antennas and metamaterial structures described at FIGS. 10B-10F may be extended into multi-radiator arrays such as patch antenna arrays 330, 340. For example, a second antenna array 1204 includes four patch antennas with a second metal pattern arranged in a 2×2 array. The metamaterial structures are disposed between each of the metal patches. The metal patches and metamaterial structures are based on the patch antenna with second metal pattern described in FIG. 10D. For example, a first metal patch may be disposed in a first area and a first pattern of metamaterial structures may be disposed in a second area surrounding the first area. A second metal patch may be disposed in a third area and a second pattern of metamaterial structures may be disposed in a fourth area. At least a portion of the second and the fourth areas is between the first and the third areas. In another example, a third antenna array 1206 includes four patch antennas with loop rings arranged in a 2×2 array. The 2×2 configuration is an example only and not a limitation as other arrays (e.g., 1×2, 1×3, 1×4, 2×3, 2×4, 3×3, 3×4, 4×4, etc.) may be used. The antenna arrays are also not limited to metal patches as strip radiators and dipole configurations may be used as active and parasitic elements. The addition of the metallic metamaterial to the PCB substrate within the near field of the antenna modifies the dielectric constant of the substrate and may be used to provide bandwidth improvements to an antenna system. An implementation of a gradient-index metamaterial may be used with a wide range of antenna configurations and is not limited to a particular antenna geometry or array structure. For example, metamaterial structures strip-shape antennas such as single-end fed, circular, and differential fed structures may be used.

Specific details are given in the description to provide a thorough understanding of example configurations (including implementations). However, configurations may be practiced without these specific details. For example, well-known circuits, processes, algorithms, structures, and techniques have been shown without unnecessary detail in order to avoid obscuring the configurations. This description provides example configurations only, and does not limit the scope, applicability, or configurations of the claims. Rather, the preceding description of the configurations provides a description for implementing described techniques. Various changes may be made in the function and arrangement of elements without departing from the spirit or scope of the disclosure.

Also, as used herein, "or" as used in a list of items prefaced by "at least one of" or prefaced by "one or more of" indicates a disjunctive list such that, for example, a list of "at least one of A, B, or C," or a list of "one or more of A, B, or C," or "A, B, or C, or a combination thereof" means A or B or C or AB or AC or BC or ABC (i.e., A and B and C), or combinations with more than one feature (e.g., AA, AAB, ABBC, etc.).

As used herein, unless otherwise stated, a statement that a function or operation is "based on" an item or condition means that the function or operation is based on the stated item or condition and may be based on one or more items and/or conditions in addition to the stated item or condition.

Components, functional or otherwise, shown in the figures and/or discussed herein as being connected, coupled (e.g., communicatively coupled), or communicating with each other are operably coupled. That is, they may be directly or indirectly, wired and/or wirelessly, connected to enable signal transmission between them.

Having described several example configurations, various modifications, alternative constructions, and equivalents may be used without departing from the spirit of the disclosure. For example, the above elements may be components of a larger system, wherein other rules may take precedence over or otherwise modify the application of the invention. Also, a number of operations may be undertaken before, during, or after the above elements are considered. Accordingly, the above description does not bound the scope of the claims.

Further, more than one invention may be disclosed.

What is claimed is:

1. An apparatus comprising:

a dielectric substrate having a first area and a second area disposed around the first area the dielectric substrate having a depth;

a first radiator disposed on a surface of the dielectric substrate in the first area, the first radiator being configured to transmit and receive radio signals at an operational frequency;

a first plurality of metamaterial structures disposed in a periodic pattern on the surface of the dielectric substrate in the second area and within a near field of the first radiator, wherein a maximum width of each of the first plurality of metamaterial structures is less than half of a wavelength of the operational frequency, and wherein the surface comprises a first plane of the dielectric substrate;

a second plurality of metamaterial structures disposed on a second plane within the dielectric substrate, the second plurality of metamaterial structures being disposed in the second area of the dielectric substrate under the first plurality of metamaterial structures, the second plane being separated from the first plane by a distance less than the depth; and a plurality of conducting vias, wherein each metamaterial structure of the first plurality of metamaterial structures is electrically coupled to a respective metamaterial structure of the second plurality of metamaterial structures with at least two conducting vias of the plurality of conducting vias to form a conductive loop structure.

2. The apparatus of claim 1 wherein the first and second pluralities of metamaterial structures disposed in the second area of the dielectric substrate increases a dielectric constant of the second area as compared to the first area at the operational frequency.

3. The apparatus of claim 1 wherein the maximum width of each of the first and second pluralities of metamaterial structures is in a range between one-fifth and one-twentieth of the wavelength of the operational frequency.

4. The apparatus of claim 1 further comprising at least a second radiator disposed on the second plane within the dielectric substrate, the second radiator being disposed in the first area of the dielectric substrate under the first radiator.

5. The apparatus of claim 4 wherein the first radiator is operably coupled to a feedline and the second radiator is a parasitic element.

6. The apparatus of claim 1 further comprising at least a second radiator disposed in a third area on the surface of the dielectric substrate, wherein at least a portion of the first plurality of metamaterial structures are disposed in a fourth area surrounding the third area on the surface of the dielectric substrate.

7. The apparatus of claim 1 wherein the first radiator is a metallic patch.

8. The apparatus of claim 1 wherein the first and second pluralities of metamaterial structures form a concentric perimeter in the second area around the first radiator.

9. The apparatus of claim 1 wherein the operational frequency is within a range from 28 gigahertz to 300 gigahertz.

10. The apparatus of claim 1 wherein the first and second pluralities of metamaterial structures are arranged in a symmetric orientation relative to the first radiator.

11. The apparatus of claim 1 further comprising a third plurality of metamaterial structures disposed on a third plane within the dielectric substrate, the third plurality of metamaterial structures being disposed in the second area of the dielectric substrate under the second plurality of metamaterial structures, the third plane being separated from the first plane by a distance less than the depth.

12. The apparatus of claim 11, further comprising:

a fourth plurality of metamaterial structures disposed on a fourth plane within the dielectric substrate, the fourth plurality of metamaterial structures being disposed in the second area of the dielectric substrate under the third plurality of metamaterial structures; and a second plurality of conducting vias, wherein each metamaterial structure of the third plurality of metamaterial structures is electrically coupled to a respective metamaterial structure of the fourth plurality of metamaterial structures with at least two conducting vias of the second plurality of conducting vias to form a conductive loop structure.

13. The apparatus of claim 12 wherein none of the first and second pluralities of metamaterial structures are electrically connected to any of the third and fourth pluralities of metamaterial structures.

14. The apparatus of claim 1 wherein each of the first plurality of metamaterial structures is configured as a metallic strip having first and second ends, the first end of each metallic strip connected to a first conducting via of the plurality of conducting vias and the second end of each metallic strip connected to a second conducting via of the plurality of conducting vias.

15. The apparatus of claim 14 further comprising a third plurality of metamaterial structures disposed on the surface in the second area, each of the third plurality of metamaterial structures being square-loop shaped.

16. The apparatus of claim 15 wherein each of the third plurality of metamaterial structures is electrically coupled to a corresponding metamaterial structure disposed on the second plane by two or more conducting vias.

17. The apparatus of claim 16 wherein the two or more conducting vias comprise four conducting vias, the four conducting vias being disposed at respective corners of the square-loop shape.

18. The apparatus of claim 15 wherein none of the third plurality of metamaterial structures are electrically connected to any other metallic structure.

19. An antenna in a wireless device for transmitting and receiving radio signals, comprising:

a first radiator disposed in a first area on a printed circuit board and configured to transmit and receive radio signals at an operational frequency;

a first plurality of metamaterial structures disposed in a periodic pattern in a second area on the printed circuit board, the second area being within a near field of the first radiator and surrounding the first area, wherein a maximum width of each of the first plurality of metamaterial structures is less than half of a wavelength of the operational frequency; and a second plurality of metamaterial structures disposed in the second area under the plurality of metamaterial structures, wherein one or more metamaterial structures of the first plurality of metamaterial structures is electrically coupled to a respective metamaterial structure of the second plurality of metamaterial structures with two or more conducting vias.

20. The antenna of claim 19 wherein the first and second pluralities of metamaterial structures disposed in the second area on the printed circuit board increases a dielectric constant of the second area of the printed circuit board at the operational frequency.

21. The antenna of claim 19 wherein the maximum width of each of the first and second pluralities of metamaterial structures is in a range between one-fifth and one-twentieth of the wavelength of the operational frequency.

22. The antenna of claim 19 further comprising at least a second radiator disposed in the first area and under the first radiator.

23. The antenna of claim 22 wherein the first radiator is operably coupled to a feedline and the second radiator is a parasitic element.

24. The antenna of claim 19 further comprising at least a second radiator disposed in a third area on the printed circuit board, wherein at least a portion of the first plurality of metamaterial structures are disposed in a fourth area on the printed circuit board encircling the third area, at least a portion of the second area and at least a portion of the fourth area being between the first area and the third area, wherein the first radiator, second radiator, and first plurality of metamaterial structures are disposed on a same plane of the printed circuit board.

25. The antenna of claim 19 wherein the first radiator is a metallic patch.

26. The antenna of claim 19 wherein each of the first plurality of metamaterial structures forms a top portion of a conductive loop ring, and wherein each respective metamaterial structure of the second plurality of metamaterial structures forms a bottom portion of the conductive loop ring.

27. The antenna of claim 19 wherein the first plurality of metamaterial structures forms a concentric perimeter around the first radiator, wherein the first plurality of metamaterial structures are formed on a first layer of the printed circuit board, wherein the second plurality of metamaterial structures are formed on a second layer of the printed circuit board, and wherein the two or more conducting vias each comprise a first end in contact with the first layer and a second end in contact with the second layer.

28. The antenna of claim 19 wherein the operational frequency is within a range from 28 gigahertz to 300 gigahertz.

* * * * *